US012473784B1

(12) United States Patent
Davis

(10) Patent No.: US 12,473,784 B1
(45) Date of Patent: Nov. 18, 2025

(54) CASING PIPE COUPLING SYSTEMS AND METHODS OF COUPLING CASING PIPES

(71) Applicant: Russell Davis, Odessa, TX (US)

(72) Inventor: Russell Davis, Odessa, TX (US)

(73) Assignee: TCI Casing Specialties, LLC, Bakersfield, CA (US)

( * ) Notice: Subject to any disclaimer, the term of this patent is extended or adjusted under 35 U.S.C. 154(b) by 0 days.

(21) Appl. No.: 19/008,627

(22) Filed: Jan. 2, 2025

(51) Int. Cl.
*E21B 19/16* (2006.01)

(52) U.S. Cl.
CPC ..... *E21B 19/161* (2013.01)

(58) Field of Classification Search
CPC ..... E21B 19/165; E21B 19/16; E21B 19/161; E21B 19/164; E21B 19/163; E21B 19/20
See application file for complete search history.

(56) References Cited

U.S. PATENT DOCUMENTS

| | | | | |
|---|---|---|---|---|
| RE28,371 | E * | 3/1975 | Winkle | E21B 19/167 173/164 |
| 6,318,214 | B1 * | 11/2001 | Buck | E21B 19/165 81/57.35 |
| 7,188,547 | B1 | 3/2007 | West et al. | |
| 7,249,639 | B2 | 7/2007 | Belik | |
| 7,350,587 | B2 | 4/2008 | Springett et al. | |
| 7,509,722 | B2 | 3/2009 | Shahin et al. | |
| 8,235,104 | B1 | 8/2012 | Sigmar et al. | |
| 8,839,881 | B1 | 9/2014 | Baumler | |
| 9,068,406 | B2 | 6/2015 | Clasen et al. | |
| 9,611,707 | B2 | 4/2017 | Yorga et al. | |
| 9,752,397 | B2 | 9/2017 | Ottersland | |
| 10,081,991 | B2 | 9/2018 | Amezaga et al. | |
| 10,233,704 | B2 * | 3/2019 | Bouligny | E21B 19/07 |
| 11,118,414 | B2 * | 9/2021 | Orr | E21B 19/155 |
| 11,613,940 | B2 | 3/2023 | McKenzie et al. | |
| 2005/0061548 | A1 * | 3/2005 | Hooper | E21B 19/20 175/85 |
| 2008/0164064 | A1 * | 7/2008 | Belik | E21B 19/155 166/380 |
| 2013/0192427 | A1 * | 8/2013 | Aarhus | B25B 21/002 81/57.32 |

(Continued)

FOREIGN PATENT DOCUMENTS

CN 103422822 B 9/2015

OTHER PUBLICATIONS

Offshore Energy Services, Inc., Scissor Lift Track Tong System.

*Primary Examiner* — Kipp C Wallace
(74) *Attorney, Agent, or Firm* — Elliott Law PLLC; Douglas H. Elliott; Nathan Q. Huynh

(57) ABSTRACT

Methods of coupling a second casing pipe to a first casing pipe are disclosed herein, which methods may include: providing a pipe guide assembly that includes: a deck; a first arm; a second arm; a first housing coupled to the first arm; a second housing coupled to the second arm; a plate rotatably coupled to the first housing and the second housing, the plate having a throat; and a piston; providing a power tong table assembly that includes: a table; a first leg; a second leg; a third leg; a fourth leg; and disposing a portion of the second casing pipe in the throat of the plate and between the first housing and the second housing; causing the first housing, the second housing, and the plate to move towards the first casing pipe; and rotating the second casing pipe using a power tong assembly.

20 Claims, 11 Drawing Sheets

(56) References Cited

U.S. PATENT DOCUMENTS

| | | | | |
|---|---|---|---|---|
| 2013/0199845 | A1 | 8/2013 | Zaleski et al. | |
| 2015/0075814 | A1 | 3/2015 | Gerwing et al. | |
| 2021/0293101 | A1* | 9/2021 | Søyland | E21B 19/164 |
| 2024/0018833 | A1* | 1/2024 | Zhang | E21B 19/20 |
| 2025/0059835 | A1* | 2/2025 | Berge | E21B 19/164 |

* cited by examiner

CASING PIPE COUPLING SYSTEMS AND METHODS OF COUPLING CASING PIPES

BACKGROUND

1. Field of Inventions

The field of this application and any resulting patent is coupling systems for pipes used in an oil or gas wells, preferably casing pipes.

2. Description of Related Art

Various pipe coupling systems and methods for positioning and coupling or decoupling of pipes have been proposed and utilized, including some of the systems, methods, and structures disclosed in some of the references appearing on the face of this patent. However, those systems, methods, and structures lack the combination of steps and/or features of the systems, methods, and/or structures disclosed herein. Furthermore, it is contemplated that the methods and/or structures disclosed herein solve many of the problems that prior art systems, methods, and structures have failed to solve. Also, the systems, methods, and/or structures disclosed herein have benefits that would be surprising and unexpected to a hypothetical person of ordinary skill with knowledge of the prior art existing as of the filing date of this application.

SUMMARY

Disclosed herein are methods of coupling a second casing pipe to a first casing pipe, which methods may include: providing a pipe guide assembly that includes: a deck having an upper surface and a lower surface; a first arm pivotably coupled to the deck; a second arm pivotably coupled to the deck; a first housing coupled to the first arm; a second housing coupled to the second arm; a plate rotatably coupled to the first housing and the second housing, the plate having a throat; and a telescopic piston pivotably coupled to the first arm or the second arm; providing a power tong table assembly that includes: a table disposed above the deck; a first leg pivotably coupled to the deck and the table; a second leg pivotably coupled to the deck and the table; a third leg pivotably coupled to the deck and the table; a fourth leg pivotably coupled to the deck and to the table; and disposing a portion of the second casing pipe in the throat of the plate and between the first housing and the second housing; extending the telescopic piston to cause the first housing, the second housing, and the plate to move towards the first casing pipe; and rotating the second casing pipe using a power tong assembly disposed on the table.

Additionally, disclosed herein are methods of coupling a second casing pipe to a first casing pipe, which methods may include: providing a pipe guide assembly that includes: a deck having an upper surface and a lower surface; a first arm pivotably coupled to the deck; a second arm pivotably coupled to the deck; a first housing coupled to the first arm; a second housing coupled to the second arm; and a plate rotatably coupled to the first housing and the second housing, the plate having a throat; providing a power tong table assembly that includes: a table disposed above the deck; a first leg pivotably coupled to the deck and the table; a second leg pivotably coupled to the deck and the table; a third leg pivotably coupled to the deck and the table; a fourth leg pivotably coupled to the deck and the table; and a telescopic piston pivotably coupled to the deck and the table; disposing a portion of the second casing pipe in the throat of the plate; moving the second casing pipe over the first casing pipe; extending the telescopic piston to cause the table and the power tong assembly to move towards the second pipe; and rotating the second casing pipe with a power tong assembly.

Also, disclosed herein are casing pipe coupling systems for coupling a second casing pipe to a first casing pipe, which systems may include: a deck having an upper deck surface and a lower deck surface; a pipe guide assembly that includes: a first arm pivotably coupled to the deck; a second arm pivotably coupled to the deck; a piston coupled either to the first arm or the second arm; a first housing; a second housing; and a horseshoe plate rotatably coupled to the first housing and the second housing, the horseshoe plate having a throat; and a power tong table assembly that includes: a table having a throat that may be capable of receiving a second portion of the second pipe; four legs pivotably coupled to the table and pivotably coupled to the deck; and a telescopic piston pivotably coupled to a lower portion of a first leg of the four legs and pivotably coupled to an upper portion of a second leg of the four legs.

In addition, disclosed herein are pipe guide assemblies for guiding pipes on an oil or gas rigs, which assemblies may include: a deck comprising a metal structure configured to be capable of being mounted to the floor of a rig; a first arm having an upper arm portion and a lower arm portion, wherein the lower arm portion may be pivotably coupled to the deck; a second arm having an upper arm portion and a lower arm portion, wherein the lower arm portion may be pivotably coupled to the deck; a first housing pivotably coupled to the first arm; a second housing pivotably coupled to the second arm; a horseshoe plate having a first plate portion rotatably coupled to the first housing and a second plate portion rotatably coupled to the second housing; a throat disposed in or proximate to the horseshoe plate; and a telescopic piston pivotably coupled to the deck and pivotably coupled either to the first arm or the second arm.

Furthermore, disclosed herein are pipe guide assemblies for guiding pipes on an oil or gas rigs, which assemblies may include: a deck having an upper deck surface and a lower deck surface; a first arm having an upper arm portion and a lower arm portion, wherein the lower arm portion may be pivotably coupled to upper deck surface; a second arm having an upper arm portion and a lower arm portion, wherein the lower arm portion may be pivotably coupled to upper deck surface; a first housing pivotably coupled to the upper arm portion of the first arm; a second housing pivotably coupled to the upper arm portion of the second arm; a horseshoe plate having a first plate portion rotatably coupled to the first housing and second plate portion rotatably coupled to the second housing; a throat disposed in the horseshoe plate; and a telescopic piston having a first piston end pivotably coupled to the deck and a second piston end pivotably coupled to the first arm.

Moreover, disclosed herein are methods of supporting a power tong assembly to connect and disconnect a pipe, which methods may include: providing a power tong table assembly that may include: a deck; a table disposed above the deck, the table having a throat; a power tong assembly disposed on the table; a first leg pivotably coupled to the deck and pivotably coupled to the table; a second leg pivotably coupled to the deck and pivotably coupled to the table; a third leg pivotably coupled to the deck and pivotably coupled to the table; a fourth leg coupled to a fourth portion of the deck and pivotably coupled to the table; a telescopic piston pivotably coupled to the deck and the table; disposing a portion of the pipe in the throat of the table; extending the telescopic piston to cause the table to move forward; and rotating the pipe with the power tong assembly.

Further, disclosed herein are power tong table assemblies for supporting a power tong assembly to connect or disconnect pipes, which assemblies may include: a deck; a table disposed above the deck, the table having a throat capable of receiving the pipe; a first leg pivotably coupled to the deck and also pivotably coupled to the table; a second leg pivotably coupled to the deck and also pivotably coupled to the table; a first crossbar coupled to the first leg and also pivotably coupled to the second leg; a third leg pivotably coupled to the deck and also pivotably coupled to the table; a fourth leg pivotably coupled to the deck and also pivotably coupled to the table; a second crossbar coupled to the third leg and also pivotably coupled to the fourth leg; and a telescopic piston pivotably coupled to the deck and also pivotably coupled to the table.

Disclosed herein are power tong table assemblies for supporting a power tong assembly to connect or disconnect pipes, which assemblies may include: a deck having an upper deck surface and a lower deck surface; a table disposed above the deck and having an upper table surface and a lower table surface; a first leg having a first end pivotably coupled to a first portion of the upper deck surface and a second end pivotably coupled to a first portion of the lower table surface; a second leg having a first end pivotably coupled to a second portion of the upper deck surface and a second end pivotably coupled to a second portion of the lower table surface; a first crossbar coupled to the first leg and the second leg; a third leg having a first end pivotably coupled to a third portion of the upper deck surface and a second end pivotably coupled to a third portion of the lower table surface; a fourth leg having a first end pivotably coupled to a fourth portion of the upper deck surface and a second end pivotably coupled to a fourth portion of the lower table surface; a second crossbar coupled to the third leg and the fourth leg; and a telescopic piston having a first piston end pivotably coupled to the deck and a second piston end pivotably coupled to the table.

Disclosed herein are methods of supporting a power tong assembly to connect or disconnect pipes, which methods may include: providing a power tong table assembly that that includes; a deck; a table disposed above the deck, the table having a throat; a power tong assembly disposed on the table; a first leg pivotably coupled to the deck and pivotably coupled to the table; a second leg pivotably coupled to the deck and pivotably coupled to the table; a third leg pivotably coupled to the deck and pivotably coupled to the table; a fourth leg coupled to a fourth portion of the deck and pivotably coupled to the table; a telescopic piston pivotably coupled to the deck and the table; and disposing a portion of the pipe in the throat of the table; extending the telescopic piston to cause the table to move forward; and rotating the pipe with the power tong assembly.

DETAILED DESCRIPTION

1. Introduction

Figure 1:
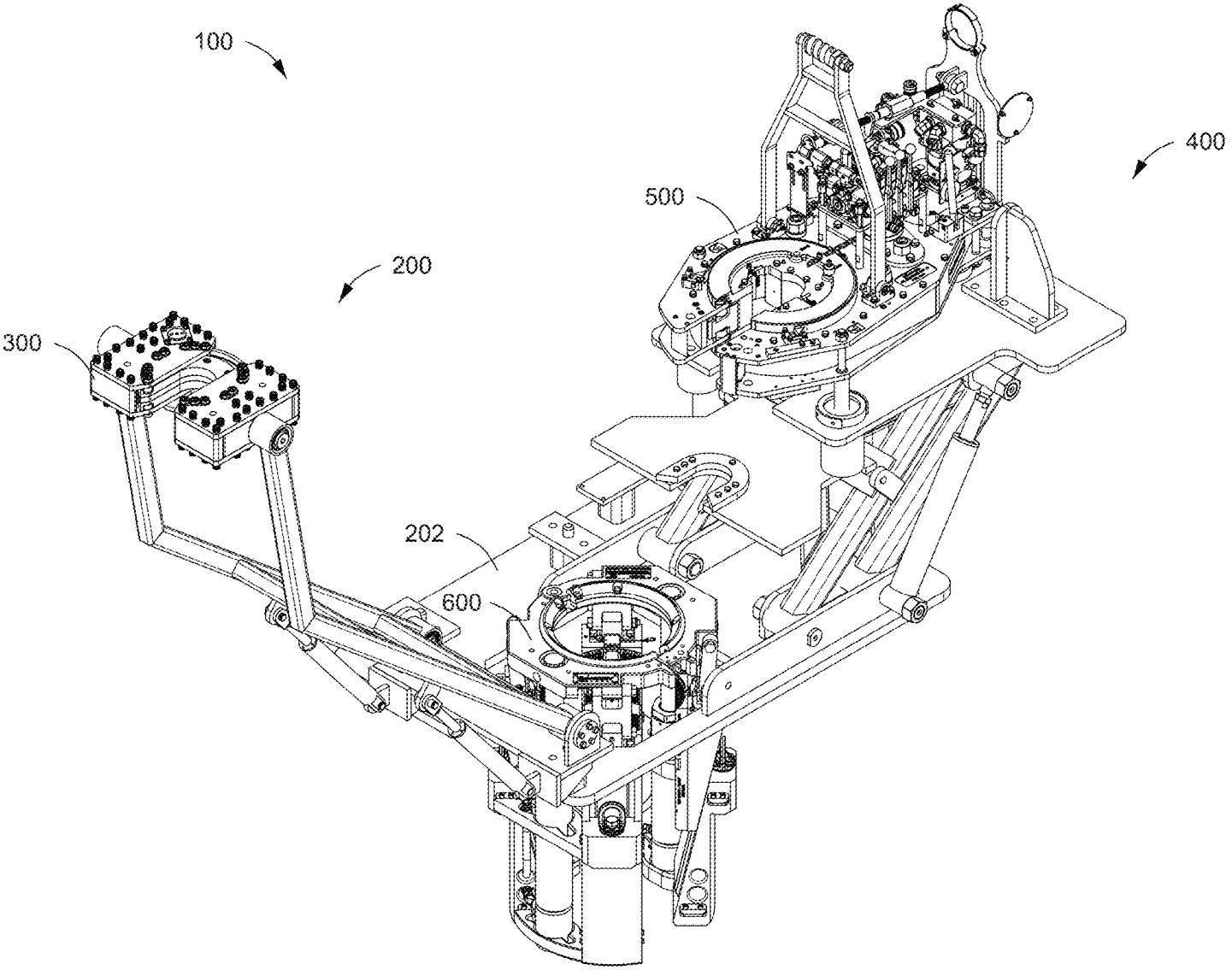
FIG. 1 illustrates a perspective view of an example of a pipe coupling system.

A detailed description will now be provided. The purpose of this detailed description, which includes the drawings, is to satisfy the statutory requirements of 35 U.S.C. § 112. For example, the detailed description includes a description of inventions defined by the claims and sufficient information that would enable a person having ordinary skill in the art to make and use the inventions. In the figures, like elements are generally indicated by like reference numerals regardless of the view or figure in which the elements appear. The figures are intended to assist the description and to provide a visual representation of certain aspects of the subject matter described herein. The figures are not all necessarily drawn to scale, nor do they show all the structural details, nor do they limit the scope of the claims.

Each of the appended claims defines a separate invention which, for infringement purposes, is recognized as including equivalents of the various elements or limitations specified in the claims. Depending on the context, all references below to the "invention" may in some cases refer to certain specific embodiments only. In other cases, it will be recognized that references to the "invention" will refer to the subject matter recited in one or more, but not necessarily all, of the claims. Each of the inventions will now be described in greater detail below, including specific embodiments, versions, and examples, but the inventions are not limited to these specific embodiments, versions, or examples, which are included to enable a person having ordinary skill in the art to make and use the inventions when the information in this patent is combined with available information and technology. Various terms as used herein are defined below, and the definitions should be adopted when construing the claims that include those terms, except to the extent a different meaning is given within the specification or in express representations to the Patent and Trademark Office (PTO). To the extent a term used in a claim is not defined below or in representations to the PTO, it should be given the broadest definition persons having skill in the art have given that term as reflected in at least one printed publication, dictionary, or issued patent.

2. Selected Definitions

Certain claims include one or more of the following terms which, as used herein, are expressly defined below.

The term "adjacent" as used herein means next to and may include physical contact but does not require physical contact.

The term "abut against" as used herein as a verb is defined as position adjacent to and either physically touch or press against, directly or indirectly. After any abutting takes place with one object relative to another object, the objects may be fully or partially "abutted." For example, a first object may be abutted against a second object such that the second object is limited from moving in a direction of the first object. Thus, a pipe may be abutted against an inner surface of a horseshoe plate.

The term "aligning" as used herein is a verb that means manufacturing, forming, adjusting, or arranging one or more physical objects into a particular position. After any aligning takes place, the objects may be fully or partially "aligned." Aligning preferably involves arranging a structure or surface of a structure in linear relation to another structure or surface; for example, such that their borders or perimeters may share a set of apertures or parallel tangential lines. In certain instances, the aligned borders or perimeters may share a similar profile. Additionally, apertures may be aligned, such that a structure or portion of a structure may be extended into and/or through the apertures.

The term "aperture" as used herein is defined as any opening in a solid object or structure, e.g., horseshoe plate, motor, piston, housing, or pipe. For example, an aperture may be an opening that begins on one side of a solid object and ends on the other side of the object. An aperture may alternatively be an opening that does not pass entirely through an object, but only partially passes through, e.g., as a groove. An aperture can be an opening in an object that is completely circumscribed, defined, or delimited by the object itself. Alternatively, an aperture can be an opening formed when one object is combined with one or more other objects or structures. An aperture may receive an object, e.g., pin or piston.

The term "assembly" as used herein is defined as any set of components that have been fully or partially assembled together. A group of components and assemblies may be combined to form a larger assembly. For example, a deck, a base, a first arm, and a second arm, and a gate assembly may be combined to form a pipe guide assembly.

The term "coupled" as used herein is defined as directly or indirectly connected or attached. A first object may be coupled to a second object such that the first object is positioned at a specific location and orientation with respect to the second object. For example, a first pipe may be coupled to a second pipe. A first object may be either permanently, removably, slidably, shearably, threadably, pivotably, rotatably, and/or fixedly coupled to a second object. Two objects are "permanently coupled," if once they are coupled, the two objects, in some cases, cannot be separated. Two objects may be "removably coupled" to each other via shear pins, threads, tape, latches, hooks, fasteners, locks, male and female connectors, clips, clamps, knots, and/or surface-to-surface contact. For example, a first pipe and a second pipe may be removably coupled to each other such that the second pipe may then be uncoupled and removed from the first pipe. "Threadably coupled" objects may be removably coupled. Accordingly, a first pipe may be threadably coupled to a second piped where a threaded inner surface, e.g., box/female threads, of the first pipe may be engaged with a threaded outer surface, e.g., pin/male threads, of the second pipe. Two objects may be "rotatably coupled," e.g., where the first object may be rotated around or rotated relative to the second object. For example, a horseshoe plate may be rotatably coupled to a transfer housing where the entire horseshoe plate may be rotated while the transfer housing remain stationary and portions of the rotating horseshoe plate enter and then exit the transfer housing. Rotatably coupled objects may still be moved axially relative to each other. Two objects may be "pivotably coupled," e.g., where the first object has a portion affixed to the second object but another portion of the first object may be pivoted and/or moved relative to the affixed portion. For example, a leg may be pivotably coupled to a deck where an end of the leg is affixed to the deck and the rest of the leg may be pivoted relative to the deck.

The term "cylindrical" as used herein is defined as shaped like a cylinder, e.g., having straight parallel sides and a circular or oval or elliptical cross-section. Examples of a cylindrical structure or object may include a motor, a collar, a piston, a housing, a mandrel, and a pipe. A cylindrical object may be completely or partially shaped like a cylinder. For example, a cylindrical object may have an aperture that is extended through the entire length of the housing to form a hollow cylinder capable of permitting another object, e.g., pipe, housing, or piston to be extended or passed through. Alternatively, a solid cylindrical object may have an inner surface or outer surface having a diameter that changes abruptly. A cylindrical object may have an inner or outer surface having a diameter that changes abruptly to form a collar, e.g., radial face, rim, or lip. A cylindrical object may have a collar extending toward or away from the central axis line of the object. A cylindrical object may have a collar disposed on an inner surface. A cylindrical object may have a collar disposed on an outer surface. Additionally, a cylindrical object may have a collar that is tapered or radiused.

The term "crossbar" as used herein is defined as any fully solid or partially solid structure configured, sized, and/or shaped to couple a first object or structure with a second object or structure, and having a length greater than its width or height. A crossbar may span two objects or structures. A crossbar may be cylindrical, e.g., it may be pipe with a circular, oval, or polygonal cross-section. An example of a polygonal cross-section may be triangular, square, rectangular, pentagonal, hexagonal, or octagonal. A cross may have respective ends coupled, e.g., welded or bolted, to two objects. A crossbar may have a shape of an "X." A crossbar having an "X" shape has four ends in which two ends are couple to a first object or structure and two other ends coupled to a second object or structure. A crossbar may be a single bar, having a first end coupled to a first object or structure and a second end coupled to a second object or structure.

The term "ingress" as used herein is defined as going in or passing through from outside a structure or space to inside the structure or space or entering that structure or space. For example, ingress of a pipe into a throat of a horseshoe plate may be achieved when the horseshoe plate is moved towards the pipe and a portion of the pipe enters the throat.

The term "egress" as used herein is defined as going out or passing through from inside a structure or space to outside the structure or space or exiting the structure or space. For example, egress of a pipe out of a throat of a horseshoe plate may be achieved when the horseshoe plate is moved away from the pipe and a portion of the pipe exits the throat.

The terms "first" and "second" as used herein merely differentiate two or more things or actions, and do not signify anything else, including order of importance, sequence, etc.

The term "gear assembly" as used herein refers to an assembly that is capable of transferring torque and includes at least one gear. A gear assembly can be, for example, a set of components assembled to form a torque-transferring unit of a gear train as part of a power tong.

Figure 3A:
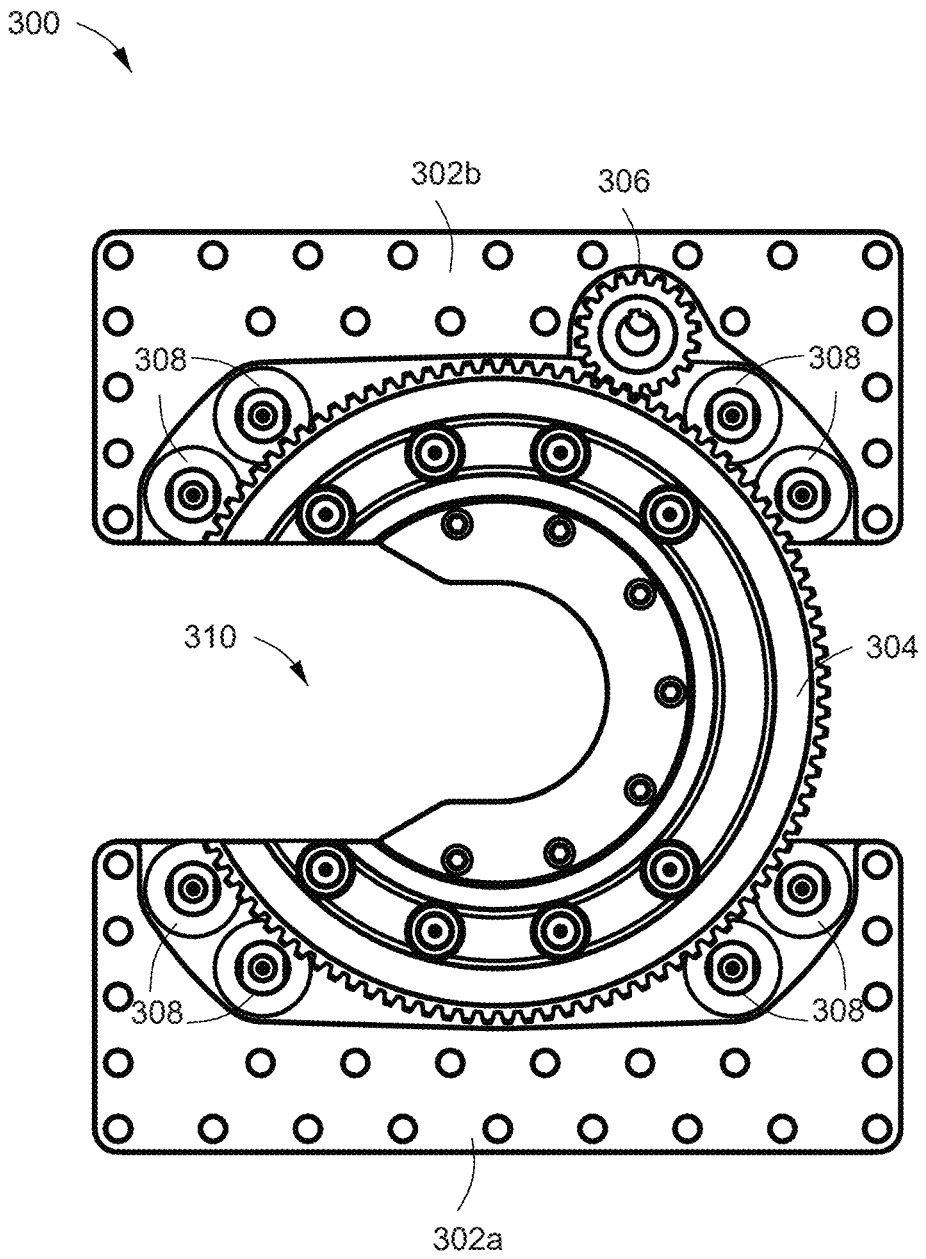
FIG. 3A illustrates an overhead inside view of an example of a transfer assembly of a pipe guide assembly in an open position.
Figure 3B:
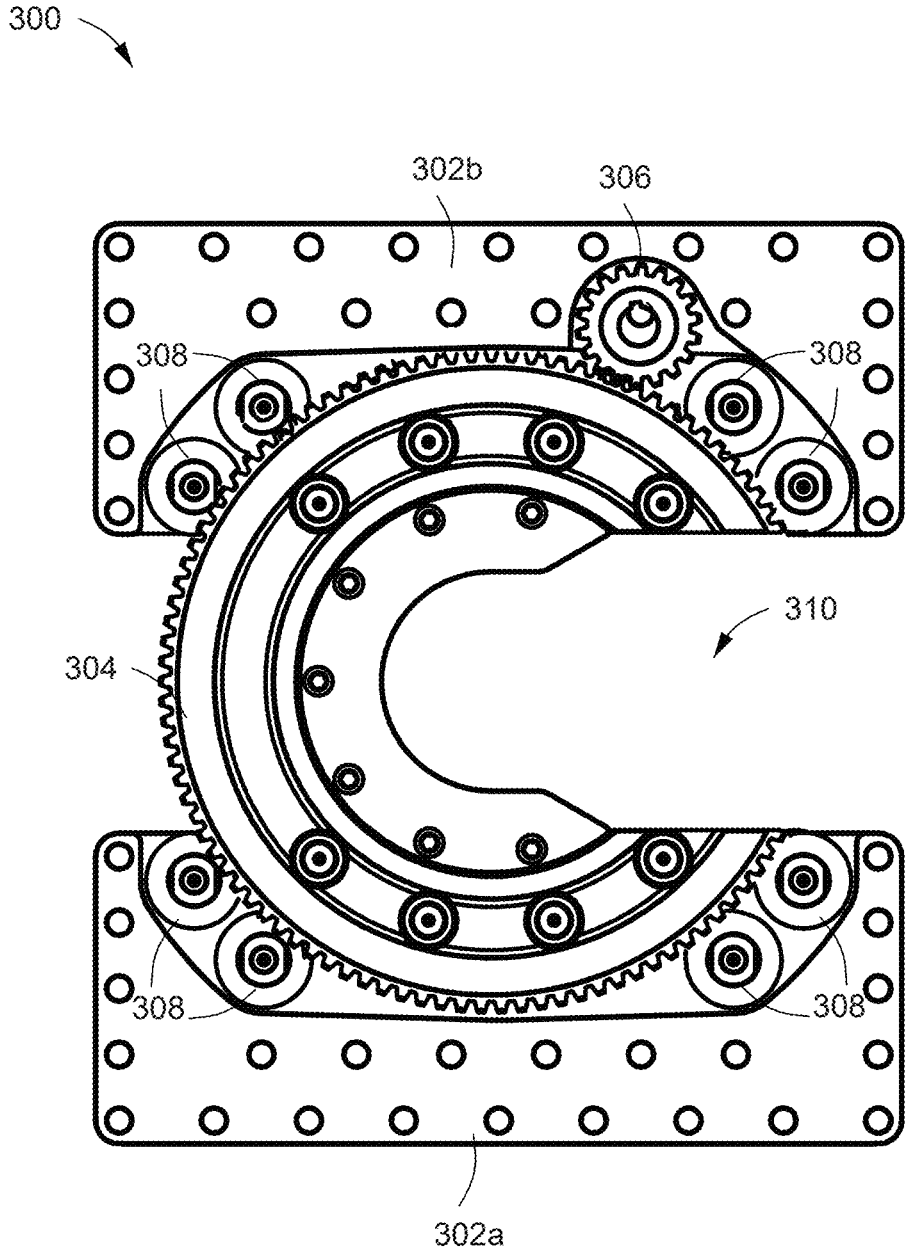
FIG. 3B illustrates an overhead inside view of the example of the transfer assembly shown in FIG. 3A in a closed position.
Figure 3C:
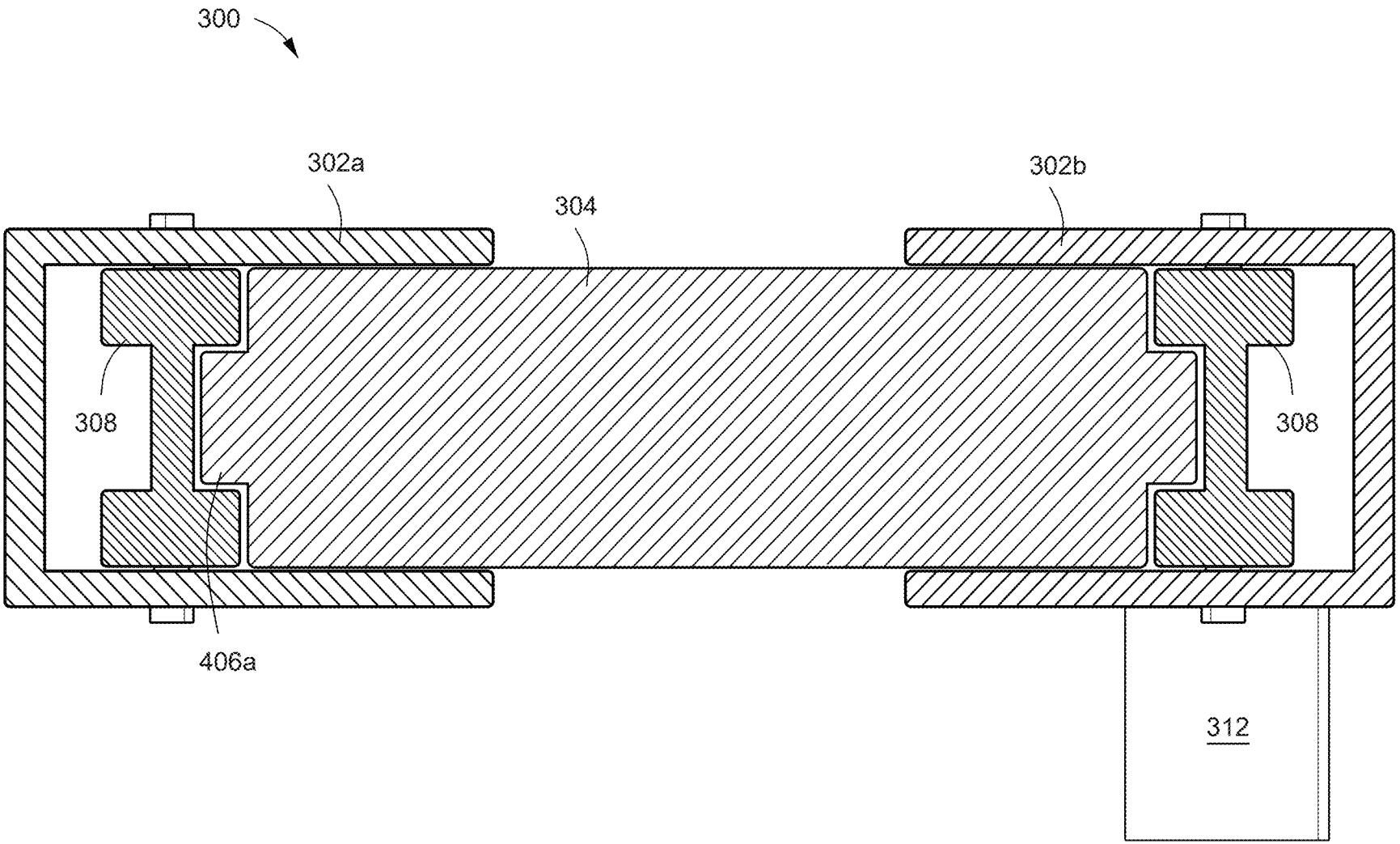
FIG. 3C illustrates a cross-sectional view of an example of a transfer assembly.

The term "gear" as used herein refers to a cylindrical assembly that includes a gear wheel and one or more bearings. A "gear" may also include teeth that intermesh with teeth on another object or structure, e.g., horseshoe plate. An example of a gear is shown in FIGS. 3A-C.

The term "housing" as used herein is defined as a structure that includes space for receiving another structure or object therein. In the context of the drawings herein, a "transfer housing" is a housing that is used to transfer a pipe, preferably casing pipe, and is preferably configured to be rotatably coupled to a horseshoe plate. A housing may have a central aperture extending therethrough. A housing may have one or more threaded ends for coupling with another housing. Multiple transfer housings may be coupled axially via a horseshoe plate. A transfer housing, e.g., of a horseshoe plate, may include motor, bearings, a pinion gear, and a portion of a horseshoe plate.

The term "leg" as used herein is defined as any fully solid or partially solid structure configured, sized, and/or shaped to support an object disposed or coupled to an end of the structure. A leg may be cylindrical, e.g., it may be pipe with a circular, oval, or polygonal cross-section. An example of a polygonal cross-section may be triangular, square, rectangular, pentagonal, hexagonal, or octagonal.

The term "motor" as used herein is defined as any device that is recognized as a "motor" by persons skilled in the art, and preferably includes any assembly capable of providing motive force, to drive movement of an object, e.g., gears, a horseshoe plate, and/or a piston, where such movement or force is preferably initiated and maintained by hydraulic pressure or electrical current. Movement of an object may include rotation of the object on a central axis. Additionally, movement may include radial displacement or axial displacement of an object relative to another object. Types of motor may include a hydraulic motor or a gear motor.

The term "moved laterally" as used herein is defined as moved or displaced in a direction parallel to the nearest planar surface, e.g., the floor of an oil or gas rig.

The term "orthogonal" as used herein is defined as at an angle ranging from 85° or 88 to 92° or 95°. Two structures that are orthogonal to each other may be perpendicular and/or tangential to each other.

The term "parallel" when referring to two lines or two planes, is defined to mean that the two lines are equidistant from each other, or the two planes are equidistant from each other.

The term "pipe" as used herein as a noun is defined as a cylindrical structure having an inner surface and an outer surface, a wall, a length greater than its width or height, two opposing ends and an opening at one or both ends. A pipe may have an aperture disposed therethrough. Examples of a pipe may include a casing pipe, a drill pipe, a leg of a power tong table assembly, an arm of a pipe guide assembly, a shaft, and a pin. Preferably, a pipe is cylindrical. However, any or all pipes of an assembly may have polygonal cross-sections, e.g., triangular, rectangular, pentagonal, hexagonal, or octagonal.

The term "pipe coupling system" as used herein is defined as a set of assemblies assembled for the purpose of directing a pipe, preferably casing pipe or drill pipe, into engagement with a power tong to couple the pipe with another pipe. For example, a pipe guide assembly, a power tong table assembly, a power tong assembly, and a flush mount assembly may be combined to form a pipe coupling system. A pipe coupling system may be installed on a pre-existing rig structure. An example of a pipe coupling system is shown in the drawings herein.

The term "pipe guide assembly" as used herein is defined as a set of objects and/or structures assembled for the purpose of directing a pipe, e.g., casing pipe or drill pipe, towards a target position. An example of a pipe guide assembly is shown in the drawings herein.

The term "power tong table assembly" as used herein is defined as a set of objects and/or structures assembled for the purpose of moving a power tong to engage a pipe, e.g., casing pipe or drill pipe, for coupling to another pipe. An example of a power tong table assembly is shown in the drawings herein.

The term "providing" as used herein is defined as making available, furnishing, supplying, equipping, or causing to be placed in position.

The term "surface" as used herein means any face of a body or thing, such as a plate or a cylinder. A "surface" may be, for example, any flat or substantially flat portion of a plate, including, for example, any part or the entire flat portion of a horseshoe plate. A surface may also refer to that flat or substantially flat area that extends radially around a cylinder which may, for example, be part of a gear shaft or a gear. One example of the term "surface" is a tong plate may have an inner surface and an outer surface, which may be flat, and the inner surface faces the internal components of a power tong and the outer surface faces the opposite direction. Another example may relate to a cylindrical structure, e.g., a washer, a gear wheel, a bearing, or a nut, having an inner surface defined by a central aperture and circumscribed by an outer surface. A surface may have irregular contours. A surface may be formed from coupled components, e.g. pipe guide assembly, power tong table assembly, power tong assembly, motor, transfer assembly, and/or pipe. Coupled components may form irregular surfaces. A plurality of surfaces may be connected to form a polygonal cross-section. An example of a polygonal cross-section may be triangular, square, rectangular, pentagonal, hexagonal, or octagonal.

The term "system" as used herein is defined as a set of one or more assemblies that have been fully or partially assembled together. A system may include a group of interrelated assemblies forming a unified whole. For example, a pipe guide assembly, a power tong table assembly, a power tong assembly, and a flush mount assembly may be combined to form a pipe coupling system.

The term "transfer assembly" as used herein is defined as an assembly with a first opening that is configured, sized, and shaped to receive a pipe and a second opening that is configured, sized, and shaped to cause, permit, or provide for the exit, delivery, release, or removal of that pipe. Preferably, the first opening and the second opening are on opposite sides of the assembly. Preferably the transfer assembly is capable of providing for the transferring of the pipe from one side of the assembly to another side of the assembly, preferably an opposite side. The transfer assembly preferably includes two transfer housings, a horseshoe plate, bearings, a pinion gear, and a motor. The rotatable horseshoe plate has an opening ("throat") that is capable of receiving a pipe on one side of the transfer assembly, then rotating so that the opening is on another side, preferably the opposite side, thus providing for the transfer of the pipe from one side of the transfer assembly to the other side. Rotational movement of a horseshoe plate of a transfer assembly may in certain cases be driven by a pinion gear having teeth enmeshed with teeth on an outer wall of the horseshoe plate. The pinion gear may be rotated by a motor. A transfer assembly may be part of a pipe guide assembly.

The term "unitary" as used herein defined as having the form of a single unit. For example, a horseshoe plate and gear teeth disposed on an outer surface of the horseshoe plate may be unitary if they are formed of a single piece of material, e.g., metal, plastic, carbon fiber, or ceramic. Also, a piston head and a piston stem that are individual parts of a piston may be unitary if they are formed into a single piece of material, e.g., plastic, carbon fiber, ceramic, or metal.

The terms "upper," "lower," "top," "bottom" as used herein are relative terms describing the position of one object, thing, or point positioned in its intended useful position, relative to some other object, thing, or point also positioned in its intended useful position, when the objects, things, or points are compared to distance from the center of the earth. The term "upper" identifies any object or part of a particular object that is farther away from the center of the earth than some other object or part of that particular object, when the objects are positioned in their intended useful positions. The term "lower" identifies any object or part of a particular object that is closer to the center of the earth than some other object or part of that particular object, when the objects are positioned in their intended useful positions. For example, a leg, an arm, a transfer housing, a horseshoe plate, a motor, a gear, and/or a bearing may each have an upper end and a lower end. Additionally, a cylindrical object, e.g., a leg, an arm, a transfer housing, a horseshoe plate, a motor, a gear, and/or a bearing, may have an upper portion and a lower portion. The term "top" as used herein means in the highest position, e.g., farthest from the ground. The term "bottom" as used herein means in the lowest position, e.g., closest the ground. For example, a cylindrical object, e.g., a leg, an arm, a transfer housing, a horseshoe plate, a motor, a gear, and/or a bearing, may have a top portion and a bottom portion.

The term "wall" as used herein is defined as any fully solid or partially solid structure having a surface. A wall may have two opposing sides. A wall may be a flat plate, e.g., disc. A wall may be cylindrical. A wall may be continuous. A wall may have curved or planar sides that may or, in some cases, may not be, parallel to one another. A wall may be rigid. A wall may be flexible. A wall may be planar. A wall may be curved. A transfer housing may have a wall. A horseshoe plate may have a wall. A wall may have one or more grooves. A wall may have one or more apertures disposed therethrough.

3. Certain Specific Embodiments

Disclosed herein are methods of coupling a second casing pipe to a first casing pipe, which methods may include: providing a pipe guide assembly that includes: a deck having an upper surface and a lower surface; a first arm pivotably coupled to the deck; a second arm pivotably coupled to the deck; a first housing coupled to the first arm; a second housing coupled to the second arm; a plate rotatably coupled to the first housing and the second housing, the plate having a throat; and a telescopic piston pivotably coupled to the first arm or the second arm; providing a power tong table assembly that includes: a table disposed above the deck; a first leg pivotably coupled to the deck and the table; a second leg pivotably coupled to the deck and the table; a third leg pivotably coupled to the deck and the table; a fourth leg pivotably coupled to the deck and to the table; and disposing a portion of the second casing pipe in the throat of the plate and between the first housing and the second housing; extending the telescopic piston to cause the first housing, the second housing, and the plate to move towards the first casing pipe; and rotating the second casing pipe using a power tong assembly disposed on the table.

Additionally, disclosed herein are methods of coupling a second casing pipe to a first casing pipe, which methods may include: providing a pipe guide assembly that includes: a deck having an upper surface and a lower surface; a first arm pivotably coupled to the deck; a second arm pivotably coupled to the deck; a first housing coupled to the first arm; a second housing coupled to the second arm; and a plate rotatably coupled to the first housing and the second housing, the plate having a throat; providing a power tong table assembly that includes: a table disposed above the deck; a first leg pivotably coupled to the deck and the table; a second leg pivotably coupled to the deck and the table; a third leg pivotably coupled to the deck and the table; a fourth leg pivotably coupled to the deck and the table; and a telescopic piston pivotably coupled to the deck and the table; disposing a portion of the second casing pipe in the throat of the plate; moving the second casing pipe over the first casing pipe; extending the telescopic piston to cause the table and the power tong assembly to move towards the second pipe; and rotating the second casing pipe with a power tong assembly.

Also, disclosed herein are casing pipe coupling systems for coupling a second casing pipe to a first casing pipe, which systems may include: a deck having an upper deck surface and a lower deck surface; a pipe guide assembly that includes: a first arm pivotably coupled to the deck; a second arm pivotably coupled to the deck; a piston coupled either to the first arm or the second arm; a first housing; a second housing; and a horseshoe plate rotatably coupled to the first housing and the second housing, the horseshoe plate having a throat; and a power tong table assembly that includes: a table having a throat that may be capable of receiving a second portion of the second pipe; four legs pivotably coupled to the table and pivotably coupled to the deck; and a telescopic piston pivotably coupled to a lower portion of a first leg of the four legs and pivotably coupled to an upper portion of a second leg of the four legs.

In addition, disclosed herein are pipe guide assemblies for guiding pipes on an oil or gas rigs, which assemblies may include: a deck comprising a metal structure configured to be capable of being mounted to the floor of a rig; a first arm having an upper arm portion and a lower arm portion, wherein the lower arm portion may be pivotably coupled to the deck; a second arm having an upper arm portion and a lower arm portion, wherein the lower arm portion may be pivotably coupled to the deck; a first housing pivotably coupled to the first arm; a second housing pivotably coupled to the second arm; a horseshoe plate having a first plate portion rotatably coupled to the first housing and a second plate portion rotatably coupled to the second housing; a throat disposed in or proximate to the horseshoe plate; and a telescopic piston pivotably coupled to the deck and pivotably coupled either to the first arm or the second arm.

Furthermore, disclosed herein are pipe guide assemblies for guiding pipes on an oil or gas rigs, which assemblies may include: a deck having an upper deck surface and a lower deck surface; a first arm having an upper arm portion and a lower arm portion, wherein the lower arm portion may be pivotably coupled to upper deck surface; a second arm having an upper arm portion and a lower arm portion, wherein the lower arm portion may be pivotably coupled to upper deck surface; a first housing pivotably coupled to the upper arm portion of the first arm; a second housing pivotably coupled to the upper arm portion of the second arm; a horseshoe plate having a first plate portion rotatably coupled to the first housing and second plate portion rotatably coupled to the second housing; a throat disposed in the horseshoe plate; and a telescopic piston having a first piston end pivotably coupled to the deck and a second piston end pivotably coupled to the first arm.

Moreover, disclosed herein are methods of supporting a power tong assembly to connect and disconnect a pipe, which methods may include: providing a power tong table assembly that may include: a deck; a table disposed above the deck, the table having a throat; a power tong assembly disposed on the table; a first leg pivotably coupled to the deck and pivotably coupled to the table; a second leg pivotably coupled to the deck and pivotably coupled to the table; a third leg pivotably coupled to the deck and pivotably coupled to the table; a fourth leg coupled to a fourth portion of the deck and pivotably coupled to the table; a telescopic piston pivotably coupled to the deck and the table; disposing a portion of the pipe in the throat of the table; extending the telescopic piston to cause the table to move forward; and rotating the pipe with the power tong assembly.

Further, disclosed herein are power tong table assemblies for supporting a power tong assembly to connect or disconnect pipes, which assemblies may include: a deck; a table disposed above the deck, the table having a throat capable of receiving the pipe; a first leg pivotably coupled to the deck and also pivotably coupled to the table; a second leg pivotably coupled to the deck and also pivotably coupled to the table; a first crossbar coupled to the first leg and also pivotably coupled to the second leg; a third leg pivotably coupled to the deck and also pivotably coupled to the table; a fourth leg pivotably coupled to the deck and also pivotably coupled to the table; a second crossbar coupled to the third leg and also pivotably coupled to the fourth leg; and a telescopic piston pivotably coupled to the deck and also pivotably coupled to the table.

Disclosed herein are power tong table assemblies for supporting a power tong assembly to connect or disconnect pipes, which assemblies may include: a deck having an upper deck surface and a lower deck surface; a table disposed above the deck and having an upper table surface and a lower table surface; a first leg having a first end pivotably coupled to a first portion of the upper deck surface and a second end pivotably coupled to a first portion of the lower table surface; a second leg having a first end pivotably coupled to a second portion of the upper deck surface and a second end pivotably coupled to a second portion of the lower table surface; a first crossbar coupled to the first leg and the second leg; a third leg having a first end pivotably coupled to a third portion of the upper deck surface and a second end pivotably coupled to a third portion of the lower table surface; a fourth leg having a first end pivotably coupled to a fourth portion of the upper deck surface and a second end pivotably coupled to a fourth portion of the lower table surface; a second crossbar coupled to the third leg and the fourth leg; and a telescopic piston having a first piston end pivotably coupled to the deck and a second piston end pivotably coupled to the table.

Disclosed herein are methods of supporting a power tong assembly to connect or disconnect pipes, which methods may include: providing a power tong table assembly that that includes; a deck; a table disposed above the deck, the table having a throat; a power tong assembly disposed on the table; a first leg pivotably coupled to the deck and pivotably coupled to the table; a second leg pivotably coupled to the deck and pivotably coupled to the table; a third leg pivotably coupled to the deck and pivotably coupled to the table; a fourth leg coupled to a fourth portion of the deck and pivotably coupled to the table; a telescopic piston pivotably coupled to the deck and the table; and disposing a portion of the pipe in the throat of the table; extending the telescopic piston to cause the table to move forward; and rotating the pipe with the power tong assembly.

Any one of the methods disclosed herein may further include trapping a portion of the second pipe between plate, the first housing, and the second housing.

Any one of the methods disclosed herein may further include releasing a portion of the second pipe from the throat of the plate.

Any one of the methods disclosed herein may further include passing a portion of the second pipe through a space between the first housing and the second housing.

Any one of the methods disclosed herein may further include passing a portion of the second pipe through a space between an upper arm portion of the first arm and an upper arm portion of the second arm.

Any one of the methods disclosed herein may further include retracting the telescopic piston to cause the first arm, the second arm, the first housing, the second housing, and the plate to move in a second direction.

Any one of the methods disclosed herein may further include retracting the telescopic piston to cause the first arm, the second arm, the first housing, the second housing, and the plate to move in a second direction opposite the first direction.

Any one of the methods disclosed herein may further include pivoting the first arm and the second arm relative to the deck by extending or retracting the telescopic piston.

Any one of the methods disclosed herein may further include pivoting the first arm and the second arm relative to the plate by extending or retracting the telescopic piston.

In any one of the methods or structures disclosed herein, the pipe guide assembly may further include a crossbar coupled to the first arm and the second arm.

In any one of the methods or structures disclosed herein, the power tong table assembly may further include a crossbar coupled to the first leg and the second leg.

In any one of the methods or structures disclosed herein, the power tong table assembly may further include a crossbar coupled to the third leg and the fourth leg.

Any one of the methods disclosed herein may further include comprising extending the telescopic piston to cause the telescopic piston, the first leg, the second leg, the third leg, and the fourth leg to pivot relative to the table.

Any one of the methods disclosed herein may further include comprising extending the telescopic piston to increase an angle formed by the deck and the first leg, the second leg, the third leg, or the fourth leg.

Any one of the methods disclosed herein may further include extending the telescopic piston to increase an angle formed by the table and the first leg, the second leg, the third leg, or the fourth leg.

Any one of the methods disclosed herein may further include retracting the telescopic piston to cause the table to move away from the second pipe.

Any one of the methods disclosed herein may further include retracting the telescopic piston to cause the first leg, the second leg, the third leg, and the fourth leg to pivot relative to the deck.

Any one of the methods disclosed herein may further include retracting the telescopic piston to decrease an angle formed by the first leg, the second leg, the third leg, or the fourth leg and the deck.

Any one of the methods disclosed herein may further include retracting the telescopic piston to decrease an angle formed by the first leg, the second leg, the third leg, or the fourth leg and the table.

In any one of the methods or structures disclosed herein, the pipe guide assembly may further include a crossbar coupled to the first arm and the second arm.

Any one of the methods disclosed herein may further include a first telescopic piston pivotably coupled to the deck and the table;

In any one of the methods or structures disclosed herein, the table may remains parallel to the deck as the table is being moved.

In any one of the methods or structures disclosed herein, the table may remain in a horizontal position as the table is being moved.

Any one of the methods disclosed herein may further include extending the second telescopic piston to cause the table and the power tong assembly to move forward.

Any one of the methods disclosed herein may further include moving the table and a power tong assembly disposed on the table toward the second pipe.

Any one of the methods disclosed herein may further include extending the telescopic piston to cause the table and a power tong assembly disposed on the table to move towards a flush mount assembly.

Any one of the methods disclosed herein may further include retracting the telescopic piston to cause the table and a power tong assembly disposed on the table to move away from a flush mount assembly.

Any one of the methods disclosed herein may further include retracting the telescopic piston to cause the table and a power tong assembly disposed on the table to move away from the first pipe.

Any one of the methods disclosed herein may further include retracting the telescopic piston to cause the table and a power tong assembly disposed on the table to move away from the flush mount assembly.

In any one of the methods or structures disclosed herein, the horseshoe plate may be capable of receiving a first portion of the second pipe.

In any one of the methods or structures disclosed herein, the throat of the horseshoe plate may be capable of receiving a first portion of the second pipe.

In any one of the methods or structures disclosed herein, the throat of the horseshoe plate may be between the first housing and the second housing.

In any one of the methods or structures disclosed herein, the throat of the horseshoe plate may be aligned with the throat of the table.

In any one of the methods or structures disclosed herein, the throat of the horseshoe plate may be adjacent the throat of the table.

In any one of the methods or structures disclosed herein, the throat of the horseshoe plate may be disposed over the throat of the table.

In any one of the methods or structures disclosed herein, the second pipe may be capable of being disposed between the first housing and the second housing.

In any one of the methods or structures disclosed herein, the second pipe may be capable of being passed through a space between the first housing and the second housing.

In any one of the methods or structures disclosed herein, the first housing and the second housing may be separated by a distance.

In any one of the methods or structures disclosed herein, the horseshoe plate may have a first portion disposed in the first housing and a second portion disposed in the second housing.

In any one of the methods or structures disclosed herein, the power tong table assembly may further include: a first crossbar coupled to a first leg and a second leg of the four legs; and a second crossbar coupled to a third leg and a fourth leg.

In any one of the methods or structures disclosed herein, the power tong table assembly may further include: a first leg pivotably coupled to the deck and pivotably coupled to the table; a second leg pivotably coupled to the deck and pivotably coupled to the table; a first crossbar coupled to the first leg and the second leg; a third leg pivotably coupled to the deck and pivotably coupled to the table; a fourth leg pivotably coupled to the deck and pivotably coupled to the table; and a second crossbar coupled to the third leg and the fourth leg.

In any one of the methods or structures disclosed herein, the first housing and the second housing may be separated by a distance.

In any one of the methods or structures disclosed herein, a portion of the pipe may be capable of being passed through a space between the first housing and the second housing.

In any one of the methods or structures disclosed herein may further include a crossbar couple to the first arm and the second arm.

In any one of the methods or structures disclosed herein, the horseshoe plate may be capable of being rotated relative to the first housing and the second housing.

In any one of the methods or structures disclosed herein, the throat may be capable of being rotated from first housing to the second housing.

In any one of the methods or structures disclosed herein, the throat may be capable of being rotated from second housing to the first housing. In any one of the methods or structures disclosed herein, the throat may be disposed between the first housing and the second housing.

In any one of the methods or structures disclosed herein, the throat may be capable of receiving the pipe.

In any one of the methods or structures disclosed herein, the first arm and the second arm may be parallel.

In any one of the methods or structures disclosed herein, the a portion of the pipe may be capable of being passed through a space between the upper arm portion of the first arm and the upper arm portion of the second arm.

In any one of the methods or structures disclosed herein, the first plate portion may be capable of being rotated out of the first housing.

In any one of the methods or structures disclosed herein, the first plate portion may be capable of being rotated into the first housing.

In any one of the methods or structures disclosed herein, the first plate portion may be capable of being rotated out of the second housing.

In any one of the methods or structures disclosed herein, the first plate portion may be capable of being rotated into the second housing.

In any one of the methods or structures disclosed herein, extension of the telescopic piston may move the respective first ends of the first leg, the second leg, the third leg, and the fourth leg in a first direction.

In any one of the methods or structures disclosed herein, extension of the telescopic piston may move the table in a first direction.

In any one of the methods or structures disclosed herein, the retraction of the telescopic piston may move the respective first ends of the first leg, the second leg, the third leg, and the fourth leg in a second direction.

In any one of the methods or structures disclosed herein, the retraction of the telescopic piston may move the table in a second direction.

In any one of the methods or structures disclosed herein, the telescopic piston may have a first piston end adjacent a lower end of the third leg and a second piston end adjacent an upper end of the first leg.

In any one of the methods or structures disclosed herein, the telescopic piston may have a first piston end adjacent a lower end of the fourth leg and a second piston end adjacent the upper end of the second leg.

In any one of the methods or structures disclosed herein, the first leg may be parallel to the second leg.

In any one of the methods or structures disclosed herein, the first leg may be parallel to the third leg.

In any one of the methods or structures disclosed herein, the first leg may be parallel the fourth leg.

In any one of the methods or structures disclosed herein, the first piston end may be adjacent a lower end of the third leg and the second piston end is adjacent an upper end of the first leg.

In any one of the methods or structures disclosed herein, the first piston end may be adjacent a lower end of the fourth leg and the second piston end is adjacent the upper end of the second leg.

4. Specific Embodiments in the Drawings

The drawings presented herein are for illustrative purposes only and do not limit the scope of the claims. Rather, the drawings are intended to help enable one having ordinary skill in the art to make and use the claimed inventions.

This section addresses specific versions of pipe handing assemblies shown in the drawings, which relate to assemblies, elements and parts that can be part of a pipe coupling system, and methods for handling pipes, e.g., including drill pipes and casing, in downhole oil and gas operations. Although this section focuses on the drawings herein, and the specific embodiments found in those drawings, parts of this section may also have applicability to other embodiments not shown in the drawings. The limitations referenced in this section should not be used to limit the scope of the claims themselves, which have broader applicability.

Although the systems, methods, structures, elements, and parts described herein have been described in detail, it should be understood that various changes, substitutions, and alterations can be made without departing from the spirit and scope of the inventions as defined by the following claims. Those skilled in the art may be able to study the preferred embodiments and identify other ways to practice the inventions that are not exactly as described herein. It is the intent of the inventors that variations and equivalents of the inventions are within the scope of the claims, while the description, abstract and drawings are not to be used to limit the scope of the inventions. The inventions are specifically intended to be as broad as the claims below and their equivalents.

FIG. 1 illustrates a perspective view of a pipe coupling system 100. The pipe coupling system 100 includes a pipe guide assembly 200, a power tong table assembly 400, and power tong assembly 500, and a flush mount assembly 600. The components of the pipe coupling system 100 are configured, preferably for installation on a floor of a rig for oil and gas production (not shown).

Figure 2:
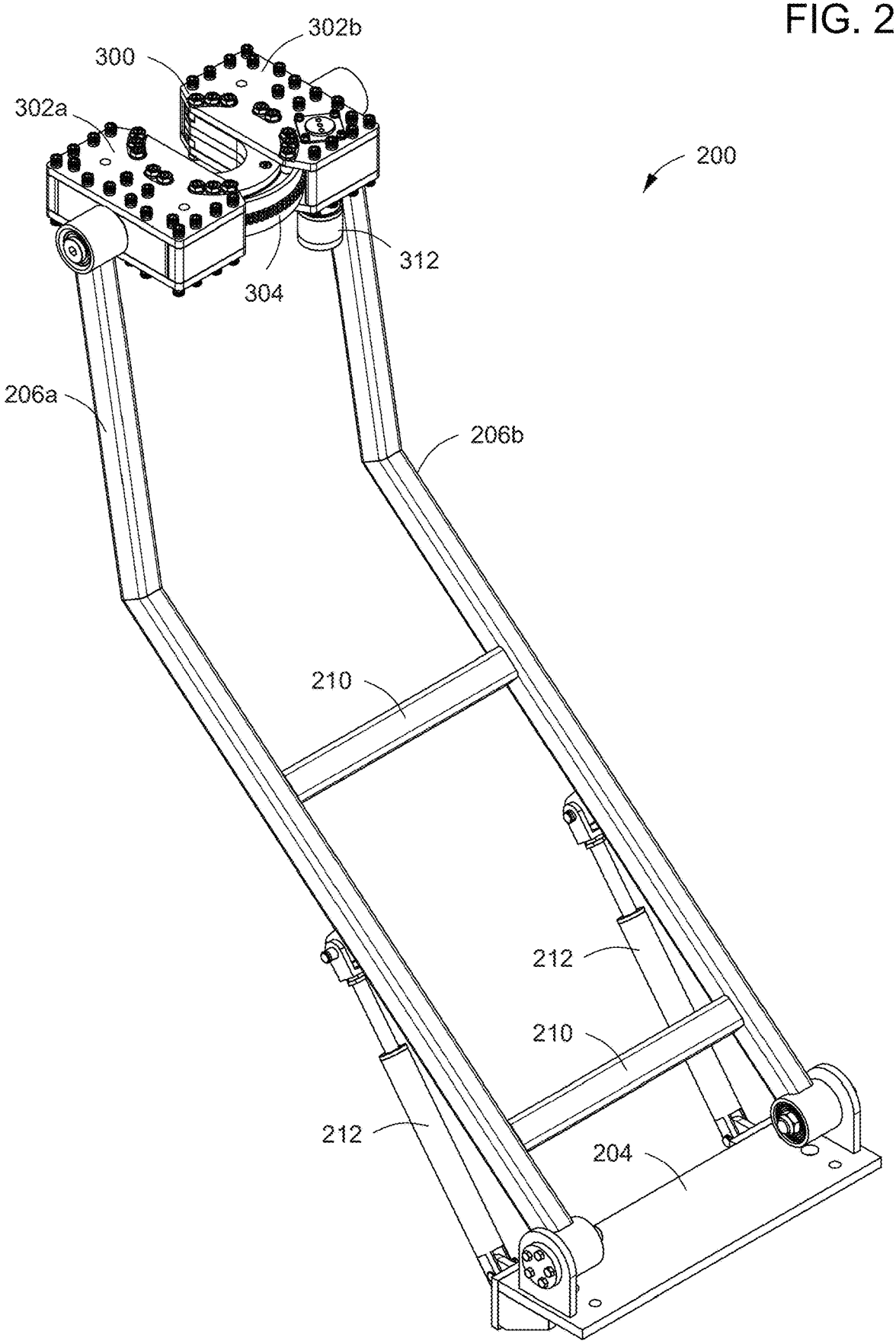
FIG. 2 illustrates a perspective view of an example of a pipe guide assembly.

FIG. 2 illustrates a perspective view of a pipe guide assembly 200. The pipe guide assembly 200 may include a deck 202 (see FIG. 1), a base 204, a first arm 206*a*, a second arm 206*b*, and a transfer assembly 300. The deck 202 is constructed from one or more steel plates. The one or more steel plates are capable of being laid flat on a rig floor. The deck 202 has an aperture disposed therethrough (see FIG. 1 and FIG. 4). When disposed on a rig floor, the aperture is capable of receiving a portion of a flush mount assembly 600 therethrough. The base 204 is coupled to the deck 202 (see FIG. 1). The first arm 206*a* and the second arm 206*b* are pivotably coupled to the base 204. The transfer assembly 300 is pivotably coupled to the first arm 206*a* and the second arm 206*b*.

Preferably, each arm 206 of the arms 206*a*, 206*b* includes a lower arm portion and an upper arm portion that form an angle. In other versions, each arm 206 may be straight. The lower arm portion and the upper arm portions may each be constructed from a single metal bar, cylinder, or plate. The lower arm portion and the upper arm portion may be unitary or coupled, e.g., welded, together. The lower arm portion and the upper arm portion may be constructed from metal bars. The lower arm portion is pivotably coupled to the base 204. Accordingly, the arms 206*a*, 206*b* are capable of being pivoted relative to the base 204.

The base 204 is coupled, e.g., bolted, to feet 208 that extend upward from the deck 202. The feet 208 are coupled, e.g., welded or bolted, to the deck 202.

The first arm 206*a* and the second arm 206*b* are coupled together by one or more crossbars 210. The one or more crossbars 210 are coupled, e.g., welded or bolted, to portions of each arm 206. The one or more crossbars 210 inhibit the first arm 206*a* and the second arm 206*b* from separating. Additionally, the one or more crossbars 210 keep the first arm 206*a* and the second arm 206*b* together when they are pivoted relative to the base 204.

Each arm 206 has a lower arm portion capable of being laid parallel to the deck 202. Additionally, the lower arm portion is capable of being pivoted to any angle from 0 degrees to 90 degrees (relative to the deck 202). A piston 212 is pivotably coupled to each lower arm portion and the base 204. The piston 212 is telescopic such that it has a first portion that extends from or retract into a second portion. An upper end of the piston 212 is pivotably coupled to the lower arm portion. A lower end of the piston 212 is pivotably coupled to the base 204. Preferably, the lower end of the piston 212 is disposed a distance, e.g., 6 inches to 12 inches, away from where the lower arm portion is pivotably coupled to the base 204. Thus, when the piston 212 is being extended, the respective arm 206 coupled to the piston 212 would pivot upwardly (away from the deck 202). Conversely, when the piston 212 is being retracted, the respective arm 206 coupled to the piston 212 would pivot downwardly (towards the deck 202).

The transfer assembly 300 is pivotably coupled to respective second portions of the first upper arm 206*a* and the second arm 206*b*. Moreover, the transfer assembly 300 is retained between the second portions of the first arm 206*a* and the second arm 206*b*. The transfer assembly 300 includes a first transfer housing 302*a*, a second transfer housing 302*b*, and a horseshoe plate 304. The first transfer housing 302*a* is pivotably coupled to the upper arm portion of the first arm 206*a*. The second transfer housing 302*b* is pivotably coupled to the upper arm portion of the second arm 206*b*.

Each transfer housing 302 has a rod extending from a sidewall of the transfer housing 302. The rod is coupled, e.g., welded or bolted, to the sidewall. The rod extends through an aperture disposed laterally in a second portion of an arm 206. Bearings (not shown) are disposed in the aperture to retain the rod in place. The bearings are capable of being rotated in place. Accordingly, the rod is capable of rotating within the aperture. Thus, a transfer housing 302 is capable of being pivoted relative to an arm 206 it is respectively coupled to.

A horseshoe plate 304 is disposed between the first transfer housing 302*a* and the second transfer housing 302*b*. A first portion of horseshoe plate 304 is disposed in the first transfer housing 302*a*. A second portion of horseshoe plate 304 is disposed in the second transfer housing 302*b*. The horseshoe plate 304 is capable of being rotated between the first transfer housing 302*a* and the second transfer housing 302*b*.

Because the first arm 206*a* and the second arm 206*b* are coupled together by one or more crossbars 210 and inhibited from separating, the first transfer housing 302*a*, the second transfer housing 302*b*, and the horseshoe plate 304 are also inhibited from separating as well. Therefore, when the first arm 206*a* and the second arm 206*b* are pivoted, e.g., by one or more pistons, the arms 206*a*, 206*b*, the transfer housings 302*a*, 302*b*, and the horseshoe plate 304 all move as a single unit.

FIG. 3A illustrates an overhead view inside a transfer assembly 300 in an open position. FIG. 3B illustrates an overhead view inside a transfer assembly 300 of a pipe guide assembly 200 in a closed position. For purposes of illustration inside the transfer assembly 300, upper covers of a first transfer housing 302*a* and a second transfer housing 302*b* have been omitted. FIG. 3C illustrates a cross-sectional view of an example of a transfer assembly 300.

Referring to FIGS. 3A-C, the transfer assembly 300 includes a first transfer housing 302*a*, a second transfer housing 302*b*, a horseshoe plate 304, a pinion gear 306, a set of bearings 308, and a motor 312. The first transfer housing 302*a* and the second transfer housing 302*b* are independent units. The first transfer housing 302*a* and the second transfer housing 302*b* are separated by a distance. The distance e.g., 6, 8, 10, 12, 16, 20, 24, 30, and 36 inches, between the transfer housings 302*a*, 302*b* may be configured so pipes of certain sizes may be passed through the transfer housings 302*a*, 302*b*. Accordingly, a pipe may pass through a space between the first transfer housing 302*a* and the second transfer housing 302*b*.

A horseshoe plate 304 has a first plate portion disposed in the first transfer housing 302*a* and a second plate portion disposed in the second transfer housing 302*b*. The horseshoe plate 304 is rotatably coupled to both the first transfer housing 302*a* and the second transfer housing 302*b*. The horseshoe plate 304 has an aperture that is preferably in the center, i.e., a central aperture, and a channel extending from the aperture to the outer edge of the horseshoe plate 304. Combined, the aperture and the channel form a D-shaped throat 310 in the horseshoe plate 304. A width, e.g., 6, 8, 10, 12, 16, and 20 inches, of the throat 310 may be configured to be equal to the distance between the transfer housings 302*a*, 302*b* so pipes of certain sizes may be disposed in the throat 310.

Within each transfer housing 302 are disposed one or more bearings 308. For illustrative purposes, the one or more bearings 308 are shown to space a small distance from the horseshoe plate 304. However, it should be understood that the one or more bearings 308 are abutted against the smooth surface of an outer (circumferential) wall of the horseshoe plate 304. The one or more bearings 308 are each capable of being rotated on its longitudinal axis when the horseshoe plate 304 is being rotated.

A pinion gear 306 is disposed in the second transfer housing 302*b*. The outer wall of the pinion gear 306 has a series of teeth that are engaged with teeth on the outer wall of the horseshoe plate 304. The pinion gear 306 is driven by the motor 312. Actuating the motor 312 causes the pinion gear 306 to rotate. The rotating pinion gear 306 causes the horseshoe plate 304 to rotate, e.g., between 1 to 360 degrees, relative to the transfer housings 302*a*, 302*b*. Accordingly, the throat 310 is rotated relative to the transfer housings 302*a*, 302*b* when the horseshoe plate 304 is being rotated.

Figure 4:
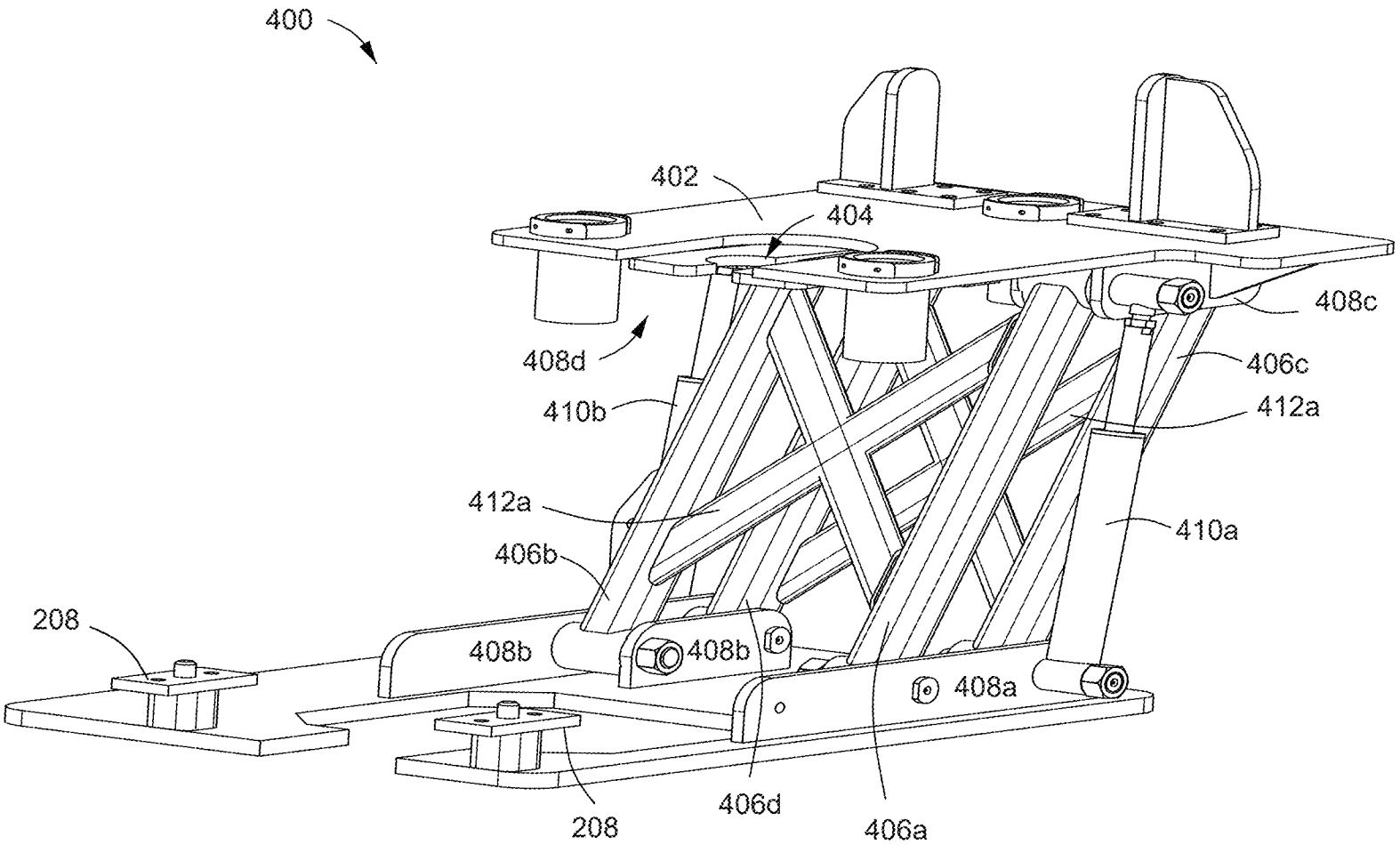
FIG. 4 illustrates a perspective view of an example of a power tong table assembly.
Figure 5A:
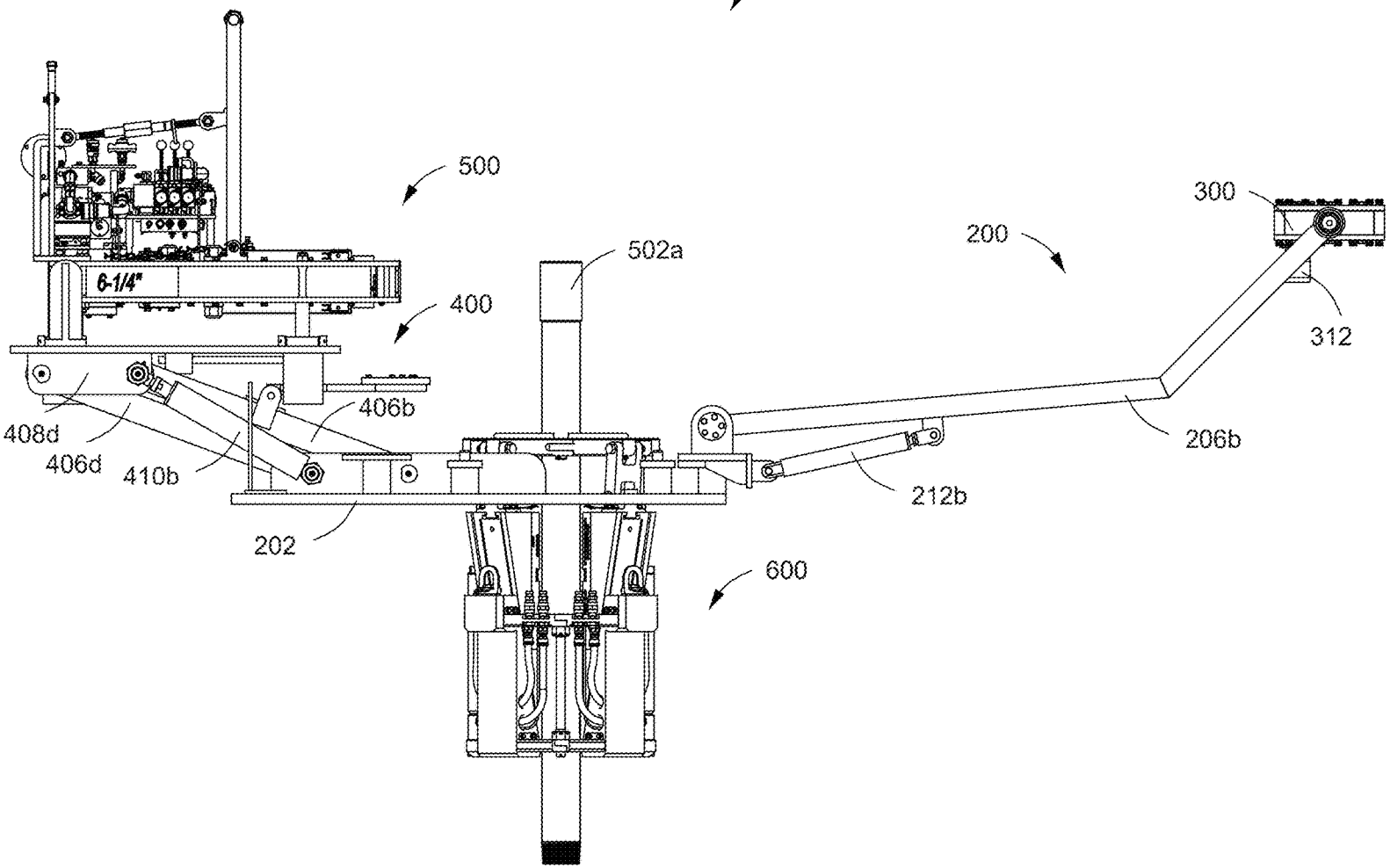
FIG. 5A illustrates a side profile view of an example of a pipe coupling system that includes a pipe guide assembly in a recline position, a power tong table assembly in a recline position, and a flush mount assembly gripping a first pipe.
Figure 5B:
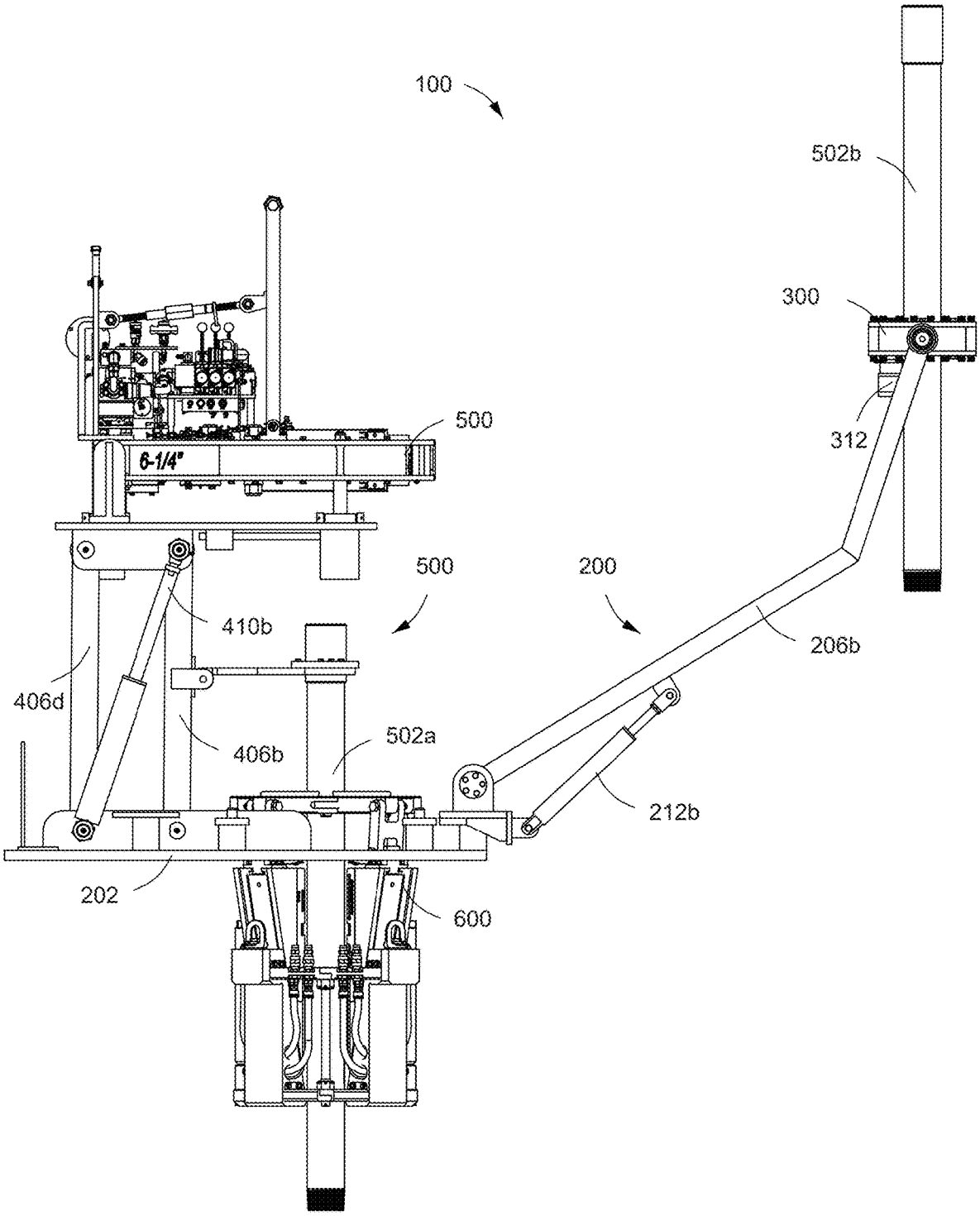
FIG. 5B illustrates a side profile view of an example of a pipe coupling system that includes a pipe guide assembly in a catch position holding a second pipe, a power tong table assembly in an actuation position, and a flush mount assembly gripping a first pipe.
Figure 5C:
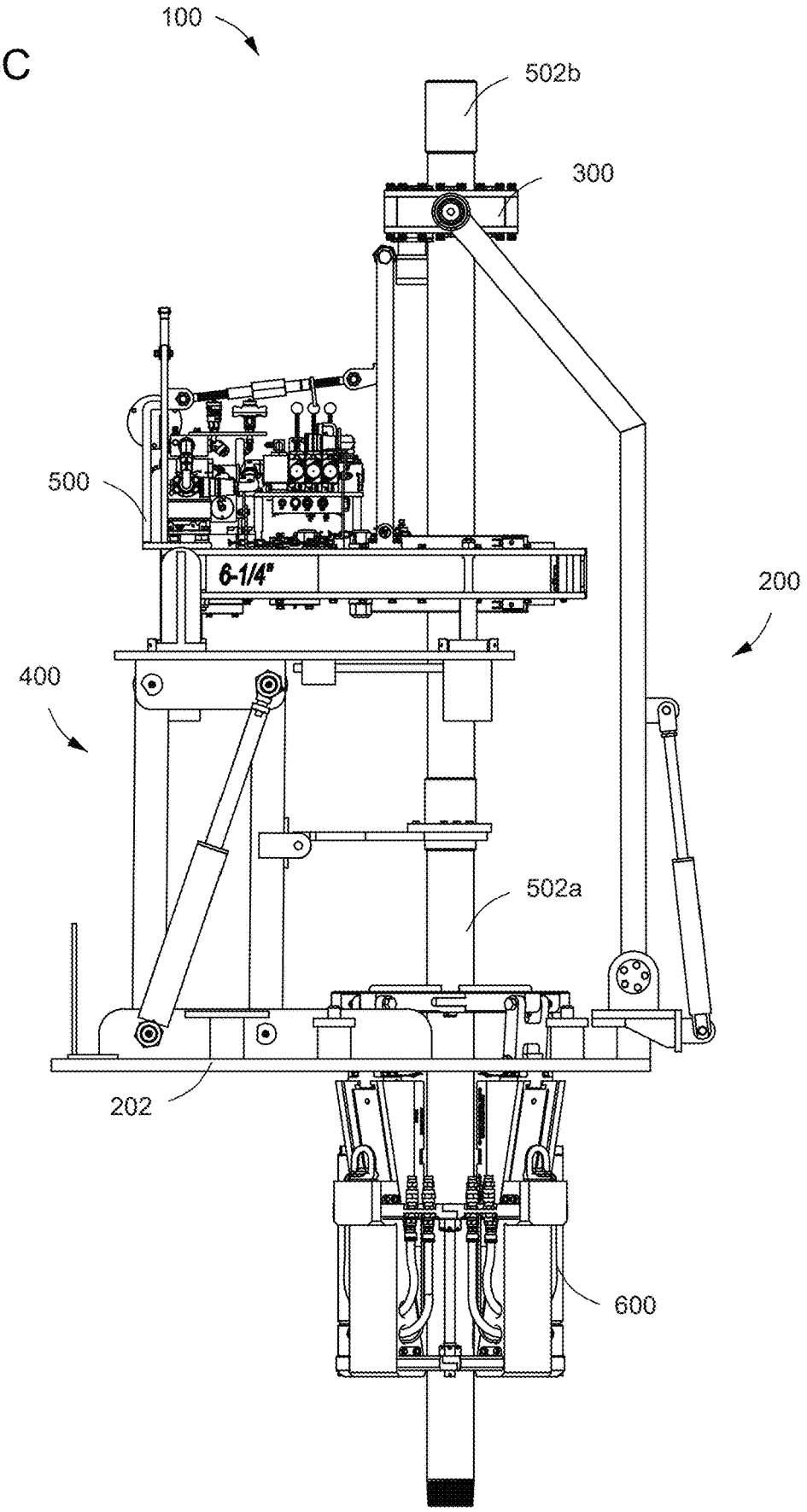
FIG. 5C illustrates a side profile view of an example of a pipe coupling system that includes a pipe guide assembly in a standing position holding a second pipe, a power tong table assembly in an actuation position, and a flush mount assembly gripping a first pipe.
Figure 5D:
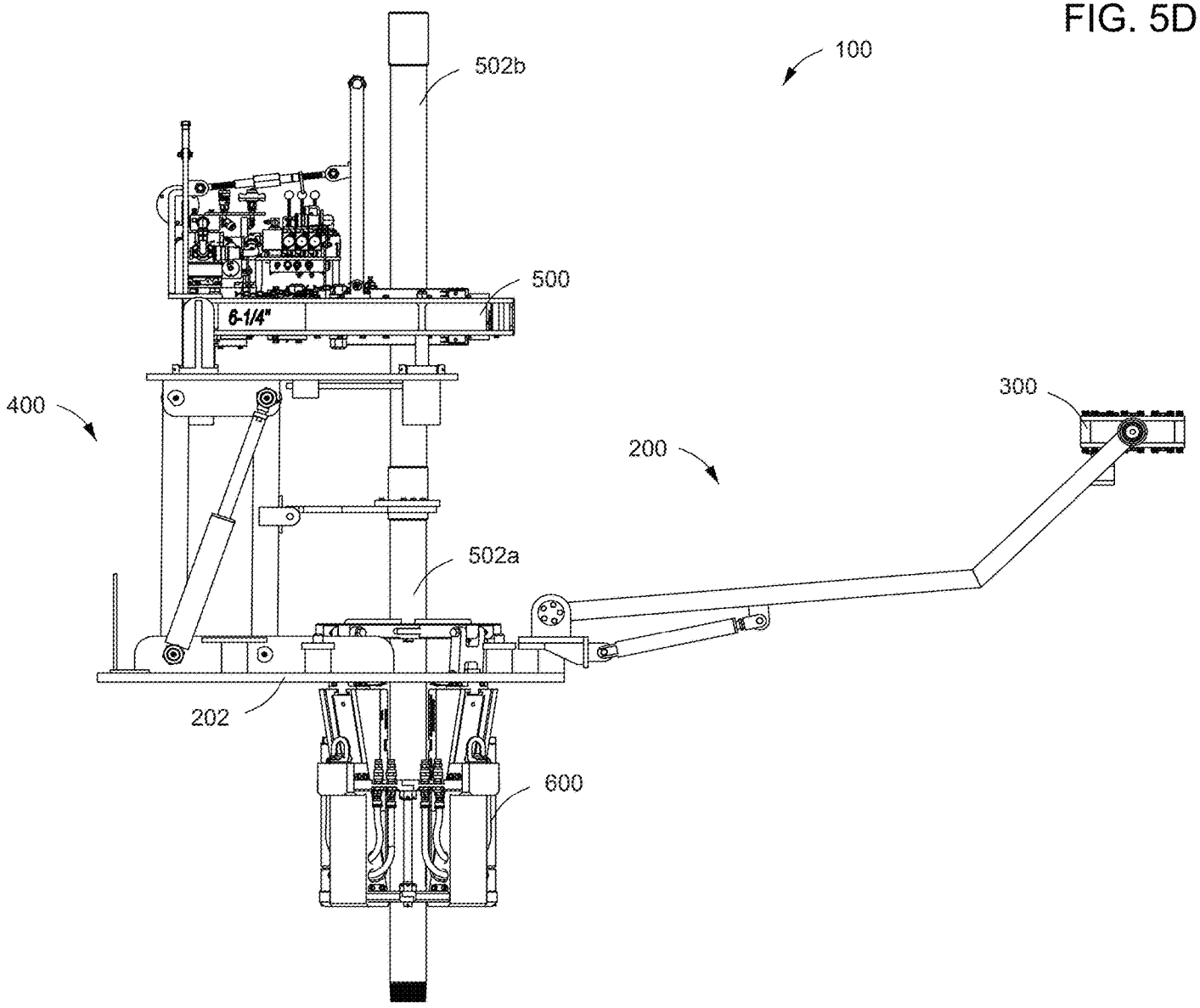
FIG. 5D illustrates a side profile view of an example of a pipe coupling system that includes a pipe guide assembly in a recline position, a power tong table assembly in an actuation position, and a flush mount assembly gripping a first pipe.
Figure 5E:
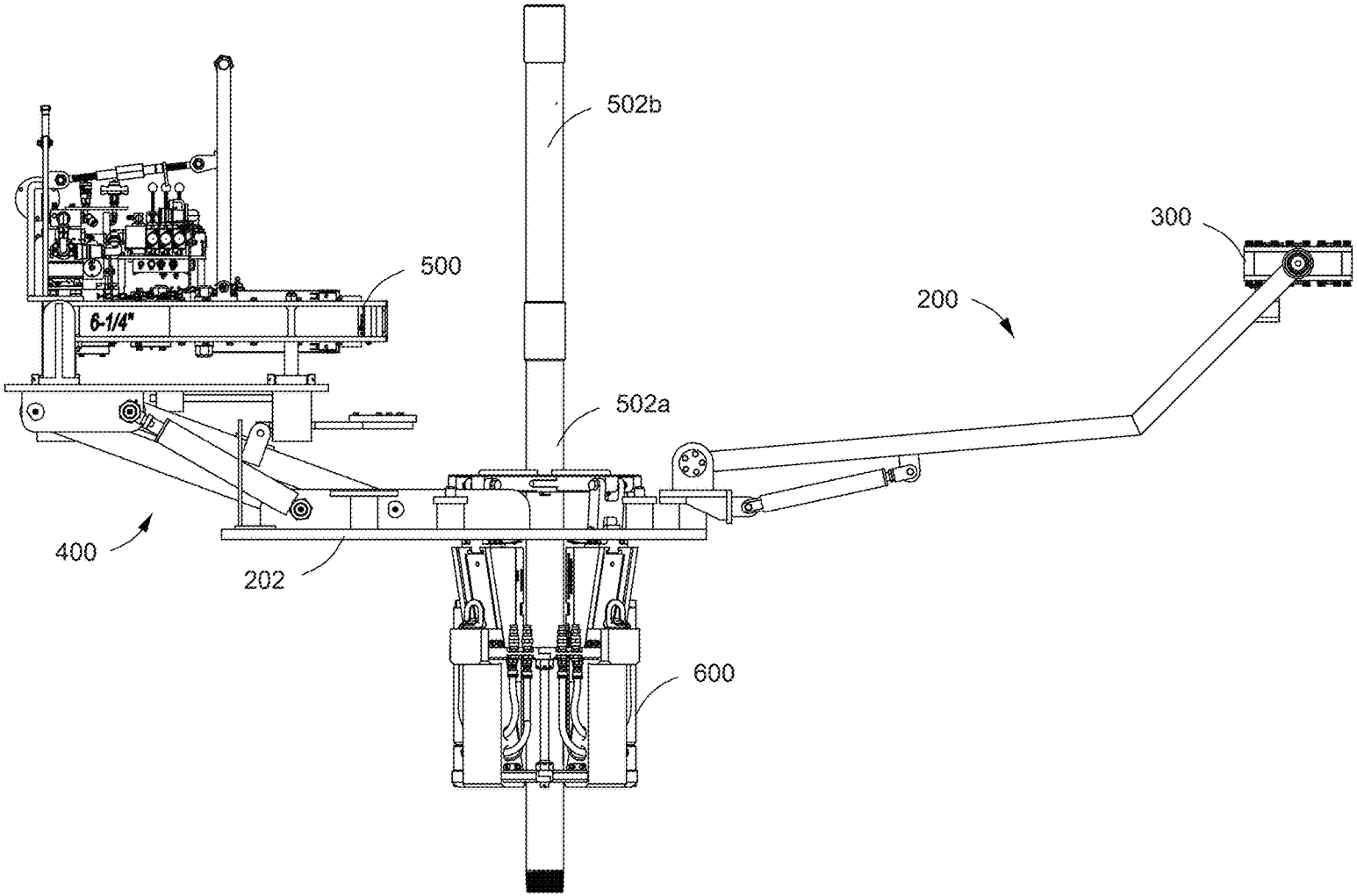
FIG. 5E illustrates a side profile view of an example of a pipe coupling system that includes a pipe guide assembly in a recline position, a power tong table assembly in a recline position, and a flush mount assembly gripping a first pipe coupled to a second pipe.

FIG. 4 illustrates a perspective view of a power tong table assembly 400. The power tong table assembly 400 includes a deck 202, a table 402, a first leg 406*a*, a second leg 406*b*, a third leg 406*c*, and fourth leg 406*d*. The table 402 has an aperture disposed therethrough. Also, the table 402 has a channel extending from the aperture to the outer edge of the table 402. Combined, the aperture and the channel form a D-shaped throat 404 in the table 402. A width, e.g., 6, 8, 10, 12, 16, and 20 inches, of the throat 404 may be configured so pipes of certain sizes may be disposed in the throat 404.

The legs 406*a-d* may each be constructed from a single metal bar, cylinder, or plate. The legs 406*a-d* are pivotably coupled to the deck 202. The deck 202 includes a first bracket 408*a* and a second bracket 408*b*. Each bracket 408 has two parallel walls extending upwardly from an upper surface of the deck 202. The first bracket 408*a* is pivotably coupled to a lower end of the first leg 406*a* and a lower end of the second leg 406*d*. The lower ends of the legs 406*a*, 406*b* have respective apertures extending therethrough. Those apertures are aligned with respective apertures in the first bracket 408*a*. Rods are extended through the apertures in the lower ends of the legs 406*a*, 406*b* and apertures of the first brackets 408*a*. Additionally, the second bracket 408*b* is pivotably coupled to a lower end of the third leg 406*c* and a lower end of the fourth leg 406*d*. The lower ends of the legs 406*c*, 406*d* have respective apertures extending laterally therethrough. Those apertures are aligned with respective apertures in the second bracket 408*b*. Rods are extended through the respective apertures in the ends of the legs 406*a-d* and apertures of the brackets 408*a-b*. Moreover, those rods are retained within their respective apertures by lock pins (not shown). Bearings (not shown) are disposed in the apertures of the legs 406*a-d*, around the rods. The bearings are capable of being rotated in place. Accordingly, the rod is capable of rotating within the aperture. Thus, each leg 408 is capable of being pivoted relative to its respective pin, making the legs 408*a-d* pivotably coupled to the deck 202.

The table 402 includes a third bracket 408*c* and a fourth bracket 408*c* that extends downwardly from a lower surface of the table 402. The third bracket 408*c* receives an upper end of the third leg 406*c* and an upper end of the fourth leg 406*d*. The upper ends of the legs 406*c*, 406*d* have respective apertures extending laterally therethrough. Those apertures are aligned with respective apertures in the third bracket 408*c*. Rods are extended through the apertures in the upper ends of the legs 406*c*, 406*d* and apertures of the brackets 408*c, d*. Additionally, the third bracket 408*c* receives an upper end of the third leg 406*c* and an upper end of the fourth leg 406*d*. The upper ends of the legs 406*c*, 406*d* have respective apertures extending laterally therethrough.

The ends of the legs 406*c*, 406*d* have respective apertures extending therethrough. Those apertures are aligned with respective apertures in the fourth bracket 408*d*. Rods are extended through the respective apertures in the lower ends of the legs 406*a-d* and apertures of the brackets 408*a-b*. Moreover, those rods are retained within their respective apertures by lock pins (not shown). Bearings (not shown) are disposed in the apertures of the legs 406*a-d* around the rods. The bearings are capable of being rotated in place. Accordingly, the rod is capable of rotating within the aperture. Thus, each leg 408 is capable of being pivoted relative to its respective rod, making the legs 408*a-d* pivotably coupled to the table 402 and the deck 202.

A first piston 410*a* is pivotably coupled to the upper end of the first leg 406*a* and the lower end of the third leg 406*c*. A second piston 410*b* is pivotably coupled to the upper end of the second leg 406*b* and the lower end of the fourth leg 406*d*. The pistons 212*a*, 212*b* are telescopic such that each piston has a first portion that extends from or retract into a second portion. Preferably, a lower end of the first piston 410*a* is disposed adjacent a lower end of the third leg 406*c* and an upper end of the first piston 410*a* is disposed adjacent an upper end of first leg 406*a*. Additionally, a lower end of the second piston 410*b* is disposed adjacent a lower end of the fourth leg 406*d* and an upper end of the piston 410*b* is disposed adjacent an upper end of the second leg 406*b*. Thus, when the pistons 410*a*, 410*b* are being extended the legs 406*a-d* would pivot upwardly (away from the deck 202). Conversely, when the pistons 410*a*, 410*b* are being retracted, the legs 406*a-d* would pivot downwardly (towards the deck 202).

A power tong assembly 500 may be set on the table 402 for pipe connection operations (see FIG. 1). During operation when the power tong assembly 500 applies torque to pipes for connection, resistance against the torquing action may occur. That resistance may be transferred from the power tong assembly 500 to the table 402 to the four legs 406*a-d*. The resistance may cause the four legs 406*a-d* to deform, e.g., twist, if they were left unreinforced. To inhibit twisting of the legs 406*a-d*, a first crossbar 412*a* is coupled and disposed between the first leg 406*a* and the second leg 406*b*. Additionally, a second crossbar 412*b* is coupled to the third leg 406*c* and the fourth leg 406*d*. The crossbars 412*a*, 412*b* have an "X" shape. Two right ends of the first crossbar 412*a* are coupled, e.g., welded, to the first leg 406*a*. Two left ends of the first crossbar 412*a* are coupled, e.g., welded, to the second leg 406*b*. Two right ends of the second crossbar 412*b* are coupled, e.g., welded, to the third leg 406*c*. Two left ends of the crossbar 412*b* are coupled, e.g., welded, to the fourth leg 406*d*. The crossbars 412*a*, 412*b* increase rigidity to the pair of the first leg 406*a* and the second leg 406*b* and to the pair of the third leg 406*c* and the fourth leg 406*d*, respectively.

The views of FIGS. 5A-E illustrate a sequence of steps for coupling a second pipe 502*b* to a first pipe 502*a* using a pipe coupling system 100 that is installed on a rig floor of an oil and gas rig or derrick. The views of FIG. 1-4 correspond to the views of FIGS. 7A-E. Initially, a first pipe 502*a* is held in position by a flush mount assembly 600. An end of the first pipe 502*a* may extend through the flush mount assembly 600, through the rig floor. An operator may use a hoisting system (not shown) to maneuver a second pipe 502*b* over a pipe guide assembly 200 in a recline position. In the recline position, a transfer assembly 300 of the pipe guide assembly 200 may have a horseshoe plate 304 set in an open position. When in the open position, a throat 310 of the horseshoe plate is facing away from a power tong table assembly 400 and the first pipe 502*a*.

The operator may actuate telescopic pistons 212*a*, 212*b* to cause a second end of each of the pistons to move away from a respective first end of each of the pistons. In other words, each piston may extend longer. The extending pistons 212*a*, 212*b* may push against respective first portions of a first arm 206*a* and a second arm 206*b*. The pushed arms 206*a*, 206*b* may be pivoted upwardly towards a standing position relative to the rig floor. While actuating the pistons 212*a*, 212*b*, the operator may further actuate the hoisting system to maneuver a portion of the second pipe 502*b* a throat 310 of horseshoe plate 304. Once the portion of the second pipe 502 is disposed in the throat 310, the operator may actuate a motor 312 to rotate a pinion gear 306. The rotating pinion gear 306 may cause the horseshoe plate 304 to rotate 90 degrees. The throat 310 may be open, e.g., face, towards a transfer housing 302. In other words, the second pipe may be trapped between the rotated horseshoe plate 304, a first transfer housing 302*a*, and a second transfer housing 302*b*. The pipe 502*b* may be abutted against a surface of the horseshoe plate 304. Accordingly, the pipe guide assembly 200 is said to be in catch position.

Next, the operator may cause the pistons 212 to further extend so that they may push the arms 206*a*, 206*b* upwardly and forwardly into a standing position. The upwardly and forwardly moving arms 206*a*, 206*b* may cause the horseshoe plate 304 to push the second pipe 502*b* towards the first pipe 502*a* (with the assistance of the hoisting system). In the standing position, the second pipe 502*b* is directly over the first pipe 502*a*. Using the hoisting system, the operator may then lower the second pipe 502*b* onto the first pipe 502*a*.

A lower end of the second pipe 502*b* may have male threads. An upper end of the first pipe 502*a* may have box threads. The operator may couple the first pipe 502*a* with the second pipe 502*b* by meshing the respective threads on the ends of the pipes 502*a*, 502*b* using a power tong assembly 500 coupled onto a table 402 of the power tong table assembly 400. First, the operator may actuate pistons 410*a*, 410*b* to cause a second end of each of the pistons 410*a*, 410*b* to move away from respective first ends of the pistons 410*a*, 410*b*. In other words, the piston 410 may extend longer. The extending pistons 410*a*, 410*b* may move, e.g., push, the table 402 and the power tong assembly 500 forward, towards the second pipe 502*b*. Legs 406*a-d* are pivotably coupled to the table 402 and the deck 202. Consequently, pushing the table 402 also pushes the power tong assembly 500 into engagement with a portion second pipe 502*b*. The pushed table 402 causes the legs 406*a-d* to pivot relative to the table 402 and the deck 202. The pivoting legs 406*a-d* permit the table 402 to remain horizontal relative to the deck 202 as the table 402 is being pushed.

The legs 406*a-d* may be pivoted until they stand orthogonally, e.g., vertically, relative to the deck 202. Accordingly, the table 402 is in an actuation position when the legs 406*a-d* are standing orthogonally to the deck 202. The operator may then actuate the power tong assembly 500 to cause the second pipe 502*b* to rotate. The rotating pipe 502*b* would case male threads on the lower end of the second pipe 502*b* to mesh with female threads on an upper end of the first pipe

502*a*. Thus, the first pipe 502*a* and the second pipe 502*b* may become threadably coupled.

Afterwards, the operator may actuate a motor 312 on the transfer assembly 300 to rotate the horseshoe plate 304 another 90 degrees so that the throat 310 is facing in the direction of the first pipe 502*a*. Then, the operator may cause the pistons 212 to retract, e.g., shorten. As the pistons 212 retract, they may pull the arms 206*a*, 206*b* away from the second pipe 502*b*. Accordingly, the transfer assembly 300 also moves together with the arms 206*a*, 206*b* as well. Because the throat 310 is open, e.g., facing, in the direction of the first pipe 502*a*, the second pipe 502*b* may exit the throat 310 as the arms 206, 206*b* move away from the second pipe 502*b*. The pistons 212*a*, 212*b* may be retracted until the arms 206*a*, 206*b* are returned to their recline positions.

Additionally, the operator may actuate pistons 410*a*, 410*b* to cause a second end of each of the pistons 410*a*, 410*b* to move towards respective first ends of the pistons 410*a*, 410*b*. In other words, the piston 410 may retract shorter. The retracting pistons 410*a*, 410*b* may move, e.g., pull on, the table 402 towards the deck 202 and away from the second pipe 502*b*. The pistons 410*a*, 410*b* may be retracted until the table 402 is returned to its recline position. Accordingly, the legs 406*a-d* may be pivoted to form angles with the deck 202 less than 90 degrees, e.g. 30, 45, 60 degrees.

What is claimed as the invention is:

1. A method of coupling a second casing pipe to a first casing pipe, comprising:

providing a pipe guide assembly that comprises:

a deck comprising an upper surface and a lower surface;

a first arm pivotably coupled to the deck;

a second arm pivotably coupled to the deck;

a first housing coupled to the first arm;

a second housing coupled to the second arm;

a plate rotatably coupled to the first housing and the second housing, the plate having a throat; and a telescopic piston pivotably coupled to the first arm or the second arm;

providing a power tong table assembly that comprises:

a table disposed above the deck;

a first leg pivotably coupled to the deck and the table;

a second leg pivotably coupled to the deck and the table;

a third leg pivotably coupled to the deck and the table;

a fourth leg pivotably coupled to the deck and to the table; and disposing a portion of the second casing pipe in the throat of the plate and between the first housing and the second housing;

extending the telescopic piston to cause the first housing, the second housing, and the plate to move towards the first casing pipe; and rotating the second casing pipe using a power tong assembly disposed on the table.

2. The method of claim 1, further comprising trapping a portion of the second pipe between plate, the first housing, and the second housing.

3. The method of claim 1, further comprising releasing a portion of the second casing pipe from the throat of the plate.

4. The method of claim 1, further comprising passing a portion of the second casing pipe through a space between the first housing and the second housing.

5. The method of claim 1, further comprising passing a portion of the second casing pipe through a space between an upper arm portion of the first arm and an upper arm portion of the second arm.

6. The method of claim 1, further comprising retracting the telescopic piston to cause the first arm, the second arm, the first housing, the second housing, and the plate to move in a second direction.

7. The method of claim 1, further comprising retracting the telescopic piston to cause the first arm, the second arm, the first housing, the second housing, and the plate to move in a second direction opposite the first direction.

8. The method of claim 1, further comprising pivoting the first arm and the second arm relative to the deck by extending or retracting the telescopic piston.

9. The method of claim 1, further comprising pivoting the first arm and the second arm relative to the plate by extending or retracting the telescopic piston.

10. The method of claim 1, wherein the pipe guide assembly further comprises a crossbar coupled to the first arm and the second arm.

11. A method of coupling a first casing pipe to a second casing pipe, comprising:

providing a pipe guide assembly that comprises:

a deck comprising an upper surface and a lower surface;

a first arm pivotably coupled to the deck;

a second arm pivotably coupled to the deck;

a first housing coupled to the first arm;

a second housing coupled to the second arm; and a plate rotatably coupled to the first housing and the second housing, the plate having a throat;

providing a power tong table assembly that comprises:

a table disposed above the deck;

a first leg pivotably coupled to the deck and the table;

a second leg pivotably coupled to the deck and the table;

a third leg pivotably coupled to the deck and the table;

a fourth leg pivotably coupled to the deck and the table; and a telescopic piston pivotably coupled to the deck and the table;

disposing a portion of the second casing pipe in the throat of the plate;

moving the second casing pipe over the first casing pipe;

extending the telescopic piston to cause the table and the power tong assembly to move towards the second pipe; and rotating the second casing pipe with a power tong assembly.

12. The method of claim 11, further comprising extending the telescopic piston to cause the telescopic piston, the first leg, the second leg, the third leg, and the fourth leg to pivot relative to the table.

13. The method of claim 11, further comprising extending the telescopic piston to increase an angle formed by the deck and the first leg, the second leg, the third leg, or the fourth leg.

14. The method of claim 11, further comprising extending the telescopic piston to increase an angle formed by the table and the first leg, the second leg, the third leg, or the fourth leg.

15. The method of claim 11, further comprising retracting the telescopic piston to cause the table to move away from the second casing pipe.

16. The method of claim 11, further comprising retracting the telescopic piston to cause the first leg, the second leg, the third leg, and the fourth leg to pivot relative to the deck.

17. The method of claim 11, further comprising retracting the telescopic piston to decrease an angle formed by the first leg, the second leg, the third leg, or the fourth leg and the deck.

18. The method of claim 11, further comprising retracting the telescopic piston to decrease an angle formed by the first leg, the second leg, the third leg, or the fourth leg and the table.

19. The method of claim 11, wherein the table remains parallel to the deck as the table is being moved.

20. The method of claim 11, wherein the pipe guide assembly further comprises a crossbar coupled to the first arm and the second arm.

* * * * *